US008103184B2

(12) United States Patent
Noguchi et al.

(10) Patent No.: US 8,103,184 B2
(45) Date of Patent: Jan. 24, 2012

(54) IMAGE FORMING APPARATUS

(75) Inventors: Hidetoshi Noguchi, Tahara (JP); Satoru Shibuya, Chiryu (JP); Hisashi Murata, Toyohashi (JP); Kazuyoshi Hara, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 420 days.

(21) Appl. No.: 12/476,719

(22) Filed: Jun. 2, 2009

(65) Prior Publication Data

US 2009/0317123 A1 Dec. 24, 2009

(30) Foreign Application Priority Data

Jun. 19, 2008 (JP) ..... 2008-160468

(51) Int. Cl.
*G03G 15/16* (2006.01)

(52) U.S. Cl. ..... 399/101

(58) Field of Classification Search ..... 399/66, 399/98, 99, 101, 100
See application file for complete search history.

(56) References Cited

U.S. PATENT DOCUMENTS

| | | | | |
|---|---|---|---|---|
| 5,729,788 | A * | 3/1998 | Hirohashi et al. | 399/66 |
| 6,256,051 | B1 * | 7/2001 | Asada et al. | 347/131 |
| 6,272,301 | B1 | 8/2001 | Kawada et al. | |
| 7,440,711 | B2 * | 10/2008 | Kishi et al. | 399/101 |
| 2007/0059027 | A1 * | 3/2007 | Ishikawa et al. | 399/101 |

FOREIGN PATENT DOCUMENTS

| | | |
|---|---|---|
| JP | 08-272233 A | 10/1996 |
| JP | 09-258581 | 10/1997 |
| JP | 2000-098846 | 4/2000 |
| JP | 2002-006577 | 1/2002 |
| JP | 2003-122098 | 4/2003 |
| JP | 2003-345212 | 12/2003 |
| JP | 2004-258479 | 9/2004 |
| JP | 2007-108200 A | 4/2007 |

OTHER PUBLICATIONS

Decision of Patent Grant dated Aug. 3, 2010, issued in the corresponding Japanese Patent Application No. 2008-160468, and an English Translation thereof.

* cited by examiner

*Primary Examiner* — Sandra Brase
(74) *Attorney, Agent, or Firm* — Buchanan Ingersoll & Rooney PC

(57) ABSTRACT

When a number of print pages, a driving time or a toner adhering amount exceeds a cleaning trigger value during no transfer operation, a circumferential speed of a secondary transfer roller is changed with respect to a circumferential speed of an intermediate transfer belt so as to clean the secondary transfer roller. Particularly, a surface of the secondary transfer roller is totally cleaned when the circumferential speed of the secondary transfer roller is made relatively faster and then slower or vice versa than the circumferential speed of the intermediate transfer belt because the surface of the secondary transfer roller is elastically deformed in both upstream and downstream directions so that the residual toner on the uneven foam surface of the secondary transfer roller is extruded.

12 Claims, 10 Drawing Sheets

IMAGE FORMING APPARATUS

CROSS-REFERENCE TO RELATED APPLICATION

This application is based on application No. 2008-160468 filed in Japan, the entire content of which is hereby incorporated by reference.

TECHNICAL FIELD

The present invention relates to an image forming apparatus with a contact transfer system which passes transfer paper through a contact section between an image carrier and a transfer roller so as to transfer a toner image onto the transfer paper.

BACKGROUND ART

There have been copying machines, facsimiles, printers and the like as examples of an image forming apparatus which uses electro photography process, and which passes transfer paper through a contact section between an image carrier and a transfer roller so as to transfer a toner image onto the transfer paper. In these image forming apparatuses, when the transfer roller is cleaned, the transfer roller is brought into contact with the image carrier. Thereafter, a positive polarity potential and a negative polarity potential are alternately applied to the transfer roller so as to transfer the toner attached to the transfer roller onto the image carrier by repulsion.

However, there have been a problem that the toner attached to the transfer roller is not fully cleaned in this electric cleaning method, so that contamination is generated in the top end and the back end of transfer materials. Accordingly, a method has been proposed, in which a circumferential speed of the image carrier and the transfer roller is changed between during transfer operation and during cleaning operation, as in an image forming apparatus disclosed in JP 08-272233 A.

FIG. 10 shows parts including the image carrier and the transfer roller in the conventional image forming apparatus disclosed in JP 08-272233 A. In FIG. 10, during cleaning operation of the transfer roller 1, a photoconductor 2 is charged to a negative polarity by the charging roller 3, so that optical write by an exposure means 4 is not performed. Also, a developing roller of a developing device 5 is not driven, and transfer materials P are not fed. In this state, the transfer roller 1 is rotated for a predetermined time in synchronization with the photoconductor 2, while a cleaning bias (bias having the same polarity as regularly-charged toner) is applied to the transfer roller 1 from a power supply 6. With the application of the cleaning bias, regularly-charged toner adhering to the transfer roller 1 is transferred onto the photoconductor 2, by which the transfer roller 1 is cleaned. In addition, when a bias having an opposite polarity to the polarity of the regularly-charged toner is applied to the transfer roller 1, the reversely-charged toner adhering to the transfer roller 1 is cleaned, thereby resulting in further enhanced cleaning performance.

In this case, the rotational speed of a main motor 8 is changed by a control means 7 so that the circumferential speed of the photoconductor 2 and the transfer roller 1 in cleaning operation is made slower than the circumferential speed of the photoconductor 2 and the transfer roller 1 in transfer operation. In other words, the photoconductor 2 and the transfer roller 1 are not given different circumferential speeds to each other, but given a relatively constant circumferential speed, and the photoconductor 2 and the transfer roller 1 are integrally changed in the circumferential speed between during the transfer operation and during the cleaning operation. Thereby, a higher cleaning performance can be obtained than that in the case where the photoconductor 2 and the transfer roller 1 are unchanged in the circumferential speed between the cleaning operation and the transfer operation.

In FIG. 10, a symbol "a" denotes a cleaning unit for the photoconductor 2, and "b" denotes a fixing device. Also, a symbol "c" denotes a power supply for the developing device 5, and "d" denotes a power supply for the charging roller 3.

The conventional image forming apparatus disclosed in JP 08-272233 A has a following problem.

When the photoconductor 2 and the transfer roller 1 are integrally changed in the circumferential speed from the transfer operation to the cleaning operation, a foam section of the transfer roller 1 is deformed on the surface of the transfer roller 1. This deformation allows toner within the foam section to be discharged from the foam section, so that cleaning is performed. However, the amount of deformation in the foam section is small since the relative circumferential speed between the photoconductor 2 and the transfer roller 1 is constant, which causes such a problem that it is hard to remove the toner residing in a deep portion of the foam section.

SUMMARY OF INVENTION

An object of the present invention is accordingly to provide an image forming apparatus which achieves sufficient cleaning of a transfer roller.

In order to achieve the above-mentioned object, one aspect of the present invention provides an image forming device which comprises a rotatable image carrier for carrying a toner image on a surface of the image carrier, an image forming section for forming a toner image on the surface of the image carrier with charged toner, a transfer roller which is rotatably put in pressure contact with the surface of the image carrier and which transfers the toner image carried on the surface of the image carrier onto a transfer material, and a circumferential speed control section for controlling a circumferential speed of at least either one of the transfer roller and the image carrier at a time of cleaning off contamination on the surface of the transfer roller so that a circumferential speed of the transfer roller is made relatively faster and then slower than a circumferential speed of the image carrier, or is made relatively slower and then faster than the circumferential speed of the image carrier.

According to the configuration, the circumferential speed of the transfer roller is controlled so as to be relatively "faster" and "slower" than the circumferential speed of the image carrier in cleaning off contamination on the surface of the transfer roller. Therefore, the residual toner adhering to the surface of the transfer roller is torn off by the frictional force generated between the transfer roller and the image carrier, which achieves sufficient cleaning of the surface of the transfer roller. Further, when the transfer roller has a foam section on its surface, the frictional force deforms the foam section. As the result, the residual toner residing inside recesses of the foam section can be extruded and therefore more sufficient cleaning of the surface of the transfer roller can be achieved.

The circumferential speed of the transfer roller is controlled so as to be relatively "faster" and then "slower" than the circumferential speed of the image carrier. Thus, in the vicinity of the contact section between the image carrier and the transfer roller whose surface is elastically deformed by frictional force, it becomes possible to clean the surface of the transfer roller in both upstream and downstream directions with respect to rotation of the transfer roller. That is, the surface region of the transfer roller can be totally cleaned.

Another aspect of the present invention provides a transfer roller cleaning method in an image forming device having: a rotatable image carrier for carrying a toner image on a surface of the image carrier; an image forming section for forming a toner image on the surface of the image carrier with charged toner; and a transfer roller which is rotatably put in pressure contact with the surface of the image carrier and which transfers the toner image carried on the surface of the image carrier onto a transfer material, the transfer roller cleaning method comprising: making the circumferential speed of the transfer roller relatively faster or slower than the circumferential speed of the image carrier; changing the circumferential speed of the transfer roller to a relatively slower circumferential speed than the circumferential speed of the image carrier when the circumferential speed of the transfer roller is relatively faster than the circumferential speed of the image carrier; and changing the circumferential speed of the transfer roller to a relatively faster circumferential speed than the circumferential speed of the image carrier when the circumferential speed of the transfer roller is relatively slower than the circumferential speed of the image carrier.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the present invention will be described in details in conjunction with the embodiments with reference to the drawings.

First Embodiment

Figure 1:
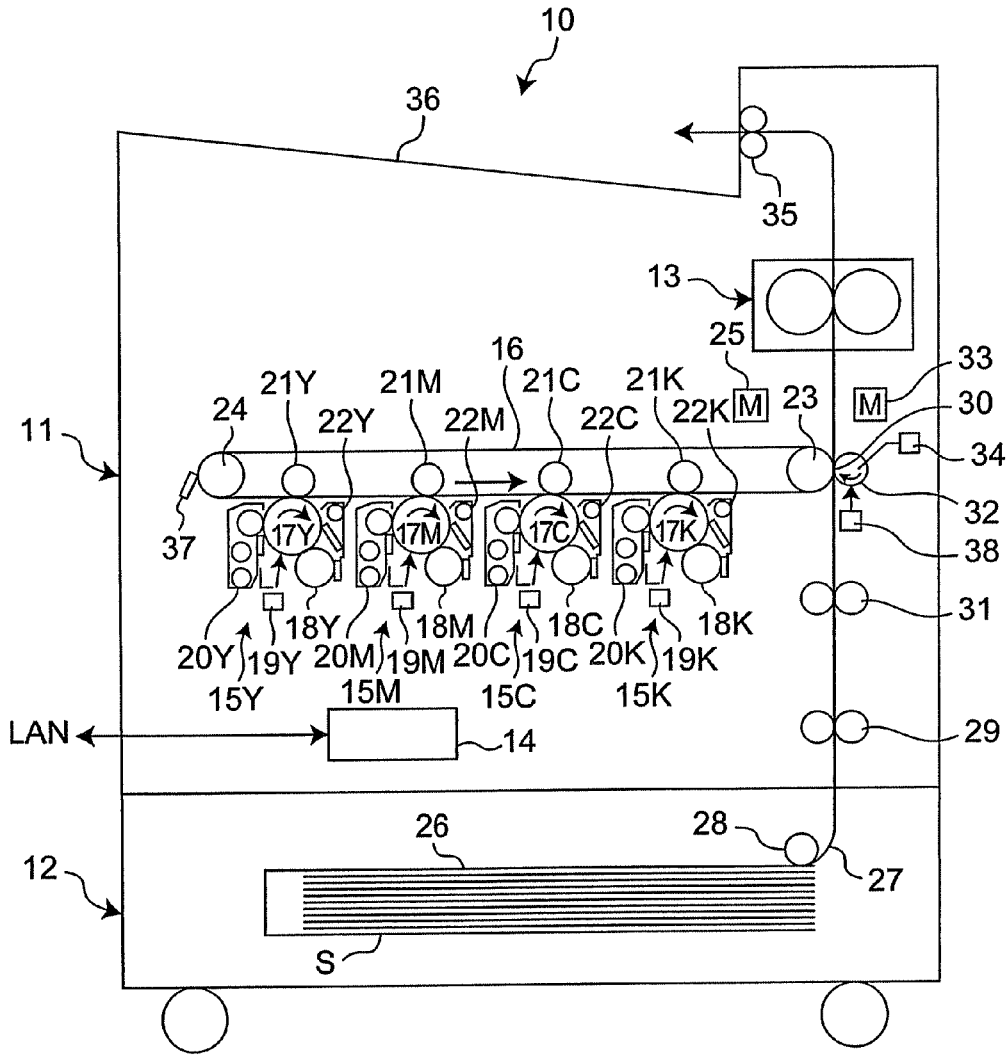
FIG. 1 shows an overall configuration view of an image forming apparatus according to the present invention.

FIG. 1 shows an overall configuration view of an image forming apparatus according to a first embodiment. With reference to FIG. 1, description is hereinbelow given of the overall configuration of the image forming apparatus in this embodiment by taking a tandem-type color digital printer (hereinafter simply referred to as a "printer") as an example.

(1) Overall Configuration of Printer

A printer 10 forms images with a known electrophotographic method. As shown in FIG. 1, the printer 10 includes an image processing section 11, a feed section 12, a fixing section 13 and a control section 14, and is connected to a network made of, e.g., LAN (Local Area Network). Upon reception of an execution instruction of a print job from an external terminal unit (not shown), the printer 10 forms a color image made up of yellow, magenta, cyan, and black colors in response to the execution instruction. Hereinafter, the reproduced colors of yellow, magenta, cyan and black are expressed as Y, M, C and K, respectively. Any component member associated with each reproduced color is designated by a reference numeral with Y, M, C or K added thereto.

The image processing section 11, which serves as an image forming section, includes imaging sections 15Y, 15M, 15C and 15K corresponding to reproduced colors Y, M, C and K, respectively, an intermediate transfer belt 16 and so on.

The imaging sections 15Y to 15K include photoconductor drums 17Y to 17K, chargers 18Y to 18K, exposure sections 19Y to 19K, developing devices 20Y to 20K, primarily transfer rollers 21Y to 21K and cleaners 22Y to 22K for cleaning the photoconductor drums 17Y to 17K, each of which is placed around the photoconductor drums 17Y to 17K. Toner images of reproduced colors Y, M, C and K are formed on the photoconductor drums 17Y, 17M, 17C and 17K, respectively. The exposure section 19Y includes a laser diode, a polygon mirror for deflecting a laser beam emitted from the laser diode to expose and scan the surface of the photoconductor drum 17Y in a main scanning direction, a scanning lens and so on, which are each placed inside the exposure section 19Y. Other exposure sections 19M to 19K have the similar configuration.

The intermediate transfer belt 16, which constitutes a part of the image processing section 11, is an endless belt. The intermediate transfer belt 16 is stretched by a driving roller 23 and a driven roller 24 so as to be rotated in the direction of arrow by a belt driving motor 25.

The feed section 12 includes a picture paper cassette 26 for storing paper sheets S as recording sheets, a supply roller 28 for supplying the paper sheets S in the picture paper cassette 26 one by one to a conveying path 27, a pair of conveying rollers 29 for conveying the supplied paper sheets S, a pair of timing rollers 31 for taking a timing of sending out the paper sheets S to a secondary transfer position 30, and a secondary transfer roller 32 which is put in pressure contact with a driving roller 23 via the intermediate transfer belt 16 at the secondary transfer position 30.

The secondary transfer roller 32 is a conductive elastic roller foamed by, for example, adding ion conductive substances to NBR (nitrile rubber). The secondary transfer roller 32 is driven by a secondary transfer roller driving motor 33 so as to rotate in the direction of arrow. A secondary transfer voltage outputted from a secondary transfer voltage output section 34 is applied to the secondary transfer roller 32. Thereby, the electrostatic force acts between the secondary transfer roller 32 and the driving roller 23 so as to be used for secondary transfer.

The fixing section 13 has a fixing roller and a pressure roller which heat and pressurize the paper sheets S at predetermined fixing temperature so as to fix a toner image.

The control section 14 converts an image signal from the external terminal unit into digital signals for respective reproduced colors Y, M, C and K and generates driving signals to drive the laser diodes of the exposure sections 19Y to 19K. By the generated driving signals, the laser diodes of the exposure sections 19Y to 19K are driven to emit laser beams L for exposing and scanning the photoconductor drums 17Y to 17K.

The photoconductor drums 17Y to 17K are uniformly charged in advance by the chargers 18Y to 18K before the exposure and scanning are performed by the exposure sections 19Y to 19K. As a result of the exposure and scanning with the laser beams L emitted from the exposure sections 19Y to 19K, electrostatic latent images are formed on the photoconductor drums 17Y to 17K.

The electrostatic latent images are developed with toner by the developing devices 20Y to 20K, respectively. Thus, toner images are obtained on the photoconductor drums 17Y to 17K. The toner images are primarily transferred onto the intermediate transfer belt 16 by the electrostatic force acting between the primarily transfer rollers 21Y to 21K and the photoconductor drums 17Y to 17K. In this case, imaging operations of respective colors are performed at shifted timings so that the toner images of respective colors may be superposed on each other at the same position on the intermediate transfer belt 16. The toner images of respective colors, which have been superposed and primarily transferred onto the intermediate transfer belt 16, are moved to a secondary transfer position 30 by rotation of the intermediate transfer belt 16.

In synchronization with the timing of the above-mentioned imaging operations of the respective colors on the intermediate transfer belt 16, paper sheets S are fed from the feed section 12 by a pair of the timing rollers 31. The paper sheets S are conveyed while being placed between the intermediate transfer belt 16 and the secondary transfer roller 32. The toner images on the intermediate transfer belt 16 are secondarily transferred in a batch onto the paper sheet S by using the electrostatic force acting between the driving roller 23 and the secondary transfer roller 32 as the transfer roller.

The paper sheet S, which has passed the secondary transfer position 30 in this way, is conveyed to the fixing section 13 where the toner images are fixed onto the paper sheet S by application of heat and pressure. Then, the paper sheet S is discharged by a discharge roller 35 and stored in a storage tray 36.

Toner remaining on the intermediate transfer belt 16 without being secondarily transferred onto the paper sheet S at the secondary transfer position 30 is cleaned by a cleaner 37 provided in such a way as to face the driven roller 24. If the toner remaining on the intermediate transfer belt 16 is attached to the secondary transfer roller 32 which is in contact with the intermediate transfer belt 16, then the secondary transfer roller 32 is contaminated with the toner. This toner contamination is detected by a contamination detection sensor 38.

The contamination detection sensor 38 is a publicly known optical sensor placed in the vicinity of the secondary transfer roller 32. The contamination detection sensor 38 optically detects the amount of residual toner adhering to the secondary transfer roller 32, and transmits a detection signal to the control section 14. The contamination detection sensor 38 may be any sensor which is capable of detecting a level of toner contamination (i.e. a value indicating the toner amount) on the surface of the secondary transfer roller 32. Specifically, CCD (Charge Coupled Device) sensors for example may be used as the contamination detection sensor 38. In the meantime, a frictional force between the secondary transfer roller 32 and the intermediate transfer belt 16 decreases as the toner adhering amount increases. Therefore, an acceleration sensor may also be used as the contamination detection sensor 38, wherein the frictional force between the secondary transfer roller 32 and the intermediate transfer belt 16 is detected to acquire the value indicating the toner adhering amount based on the detection result. It is also possible to use a reflection density sensor as the contamination detection sensor 38.

When the toner contamination of the secondary transfer roller 32 is detected by the contamination detection sensor 38, roller cleaning is performed on the secondary transfer roller 32 under control by the control section 14, as described later in detail.

Figure 2:
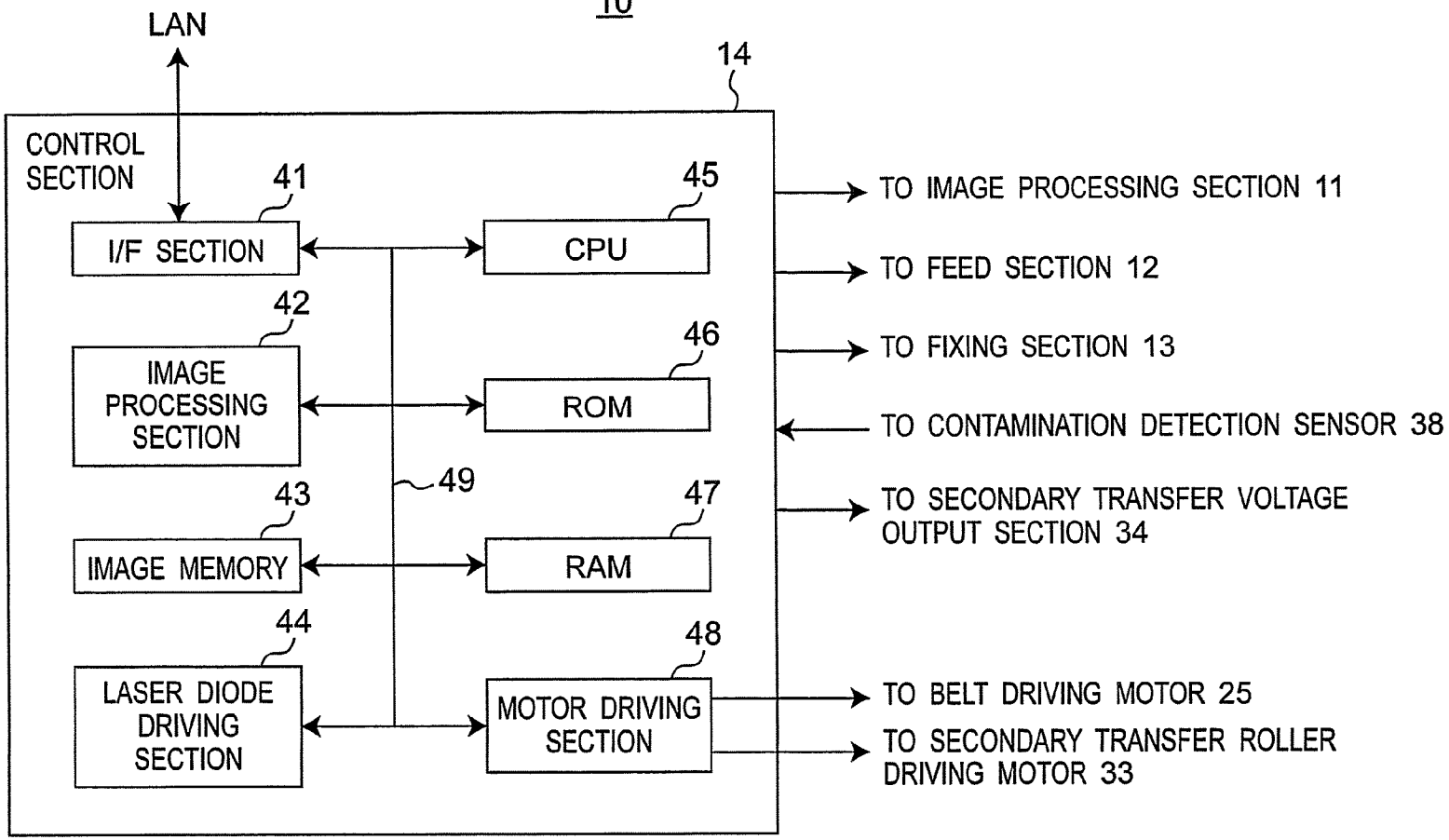
FIG. 2 shows a configuration block diagram for a control section of the image forming apparatus shown in FIG. 1.

FIG. 2 shows a block diagram of the configuration of the control section 14. As shown in FIG. 2, the control section 14 includes a communication I/F (interface) section 41, an image processing section 42, an image memory 43, a laser diode driving section 44, a CPU (Central Processing Unit) 45, a ROM (Read Only Memory) 46, a RAM (Random Access Memory) 47 and a motor driving section 48. The sections 41 to 48 can communicate with each other via a bus 49.

The communication I/F section 41, which is an interface for LAN connections such as LAN cards and LAN boards, receives print job data from the outside and transmits the received data to the image processing section 42. The image processing section 42 converts the print job data from the communication I/F section 41 into image data of the reproduced colors Y to K, and outputs the converted image data to the image memory 43 which stores the data. At the time of job execution, the laser diode driving section 44 reads the image data from the image memory 43 and drives the laser diodes of the exposure sections 19Y to 19K.

The motor driving section 48 drives the belt driving motor 25 and the secondary transfer roller driving motor 33 under control by the CPU 45. The ROM 46 stores control programs including a control program relating to print operation, a control program relating to image formation, and a control program relating to roller cleaning operation for cleaning the secondary transfer roller 32. The RAM 47 is used as a work area for the CPU 45.

In the above configuration, the CPU 45 reads the control program relating to the print operation from the ROM 46. In accordance with the read control program, the CPU 45 systematically controls each section, e.g., the image processing section 11, the feed section 12 and the fixing section 13, while taking the timing of each operation, so as to enable each section to perform smooth print operation. At the time of image formation, the CPU 45 controls the motor driving section 48 in accordance with the control program relating to the image formation, and rotates the intermediate transfer belt 16 and the secondary transfer roller 32 so that their circumferential speed may become a prescribed speed (which correspond to a system speed of the printer 10). The CPU 45 further controls the secondary transfer voltage output section 34 so that a voltage having a polarity opposite to the polarity of the toner is applied to the secondary transfer roller 32 as a secondary transfer voltage. At the time of roller cleaning operation, the CPU 45 performs roller cleaning operation in accordance with the control program relating to the roller cleaning operation.

Figure 3:
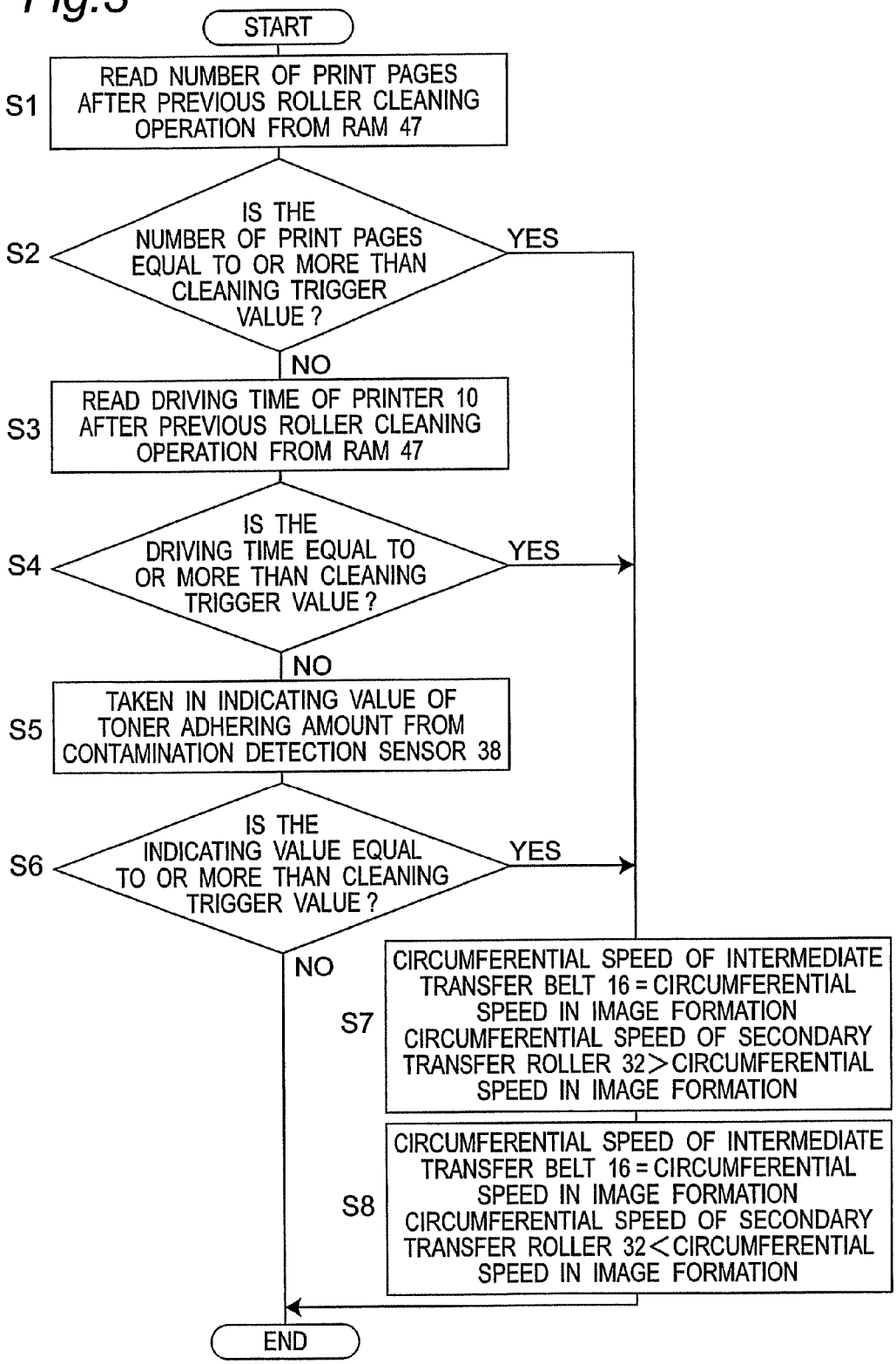
FIG. 3 shows a flow chart of roller cleaning processing operation performed under control by a CPU shown in FIG. 2.

FIG. 3 shows a flow chart of the roller cleaning processing operation which is performed under control of the CPU 45. The roller cleaning processing operation is performed during a period of time when the secondary transfer operation is not operated (i.e. while the transfer operation is not performed). Specifically, the roller cleaning processing operation is performed, for example, during a period of time (print gap) from the moment the rear end of the n-th paper sheet S passes the secondary transfer position 30 until the top end of the (n+1)-th paper sheet S reaches the secondary transfer position 30, immediately before the start of job execution, immediately after the job end, after the end of prescribed number of printing operations, and the like. In the present embodiment, the roller cleaning processing operation is performed immediately before the start of job execution.

In the present embodiment, the ROM 46 stores cleaning conditions under which the roller cleaning operation of the secondary transfer roller 32 is performed. The cleaning conditions include: (1) a cleaning trigger value based on the number of print pages after the previous roller cleaning operation; (2) a cleaning trigger value based on the driving time of the printer 10 after the previous roller cleaning operation; and (3) a cleaning trigger value based on a value indicating the toner adhering amount from the contamination detection sensor 38. In the present embodiment, the roller cleaning processing operation is performed when any one of the cleaning conditions (1), (2) and (3) is met.

The "cleaning trigger value" may herein be set as a number of print pages or a driving time until the following specified amount of the residual toner is attached to the secondary transfer roller 32. The specified amount is defined as one in such a level that if the residual toner beyond the specified amount is attached to the roller, then the residual toner is in turn attached to the back side of the paper sheet S during transfer operation, and therefore when the back side of the paper sheet S is observed by a person after the paper sheet S is discharged via fixing section 13, toner contamination on the back side of the paper is possibly sensed by the person. Further, the specified amount is in such a level that the toner (e.g., toner charged to a polarity opposite to the regular polarity of the toner) remaining on the secondary transfer roller 32 without being cleaned by electric cleaning functions to some extent as a lubricant between the intermediate transfer belt 16 and the secondary transfer roller 32 so that even if physical cleaning is used the surface of the secondary transfer roller 32 is not worn out (the frictional force, which is likely to wear out the secondary transfer roller 32, is not generate). Alternatively, the "cleaning trigger value" may be set as a value indicating that the "specified amount" of the residual toner has been attached to the secondary transfer roller 32. The data on the "cleaning trigger value" can be acquired in advance from an experiment and the like.

The values of "the number of print pages after the previous roller cleaning operation" and "the driving time of the printer 10 after the previous roller cleaning operation" are constantly updated and stored in the RAM 47.

Immediately before start of job execution, the roller cleaning processing operation is started. In Step S1, the CPU 45 reads the number of print pages after the previous roller cleaning operation from the RAM 47. In Step S2, it is determined whether or not the number of print pages read in the Step S1 is equal to or more than the cleaning trigger value read from the ROM 46. As a result, if the number of print pages is equal to or more than the cleaning trigger value, then the procedure proceeds to Step S7. If not, the procedure proceeds to Step S3. In Step S3, the CPU 45 reads the driving time of the printer 10 after the previous roller cleaning operation from the RAM 47. Further in Step S4, it is determined whether or not the driving time of the printer 10 read in the Step S3 is equal to or more than the cleaning trigger value read from the ROM 46. As a result, if the driving time of the printer 10 is equal to or more than the cleaning trigger value, then the procedure proceeds to Step S7. If not, the procedure proceeds to Step S5. In Step S5, the CPU 45 takes in a value indicating the toner adhering amount based on a detection signal from the contamination detection sensor 38. In Step S6, it is determined whether or not the value indicating the toner adhering amount taken in the Step S5 is equal to or more than the cleaning trigger value read from the ROM 46. As a result, if the value indicating the toner adhering amount is equal to or more than the cleaning trigger value, then the procedure proceeds to Step S7. If not, the roller cleaning processing operation is ended.

In Step S7, through controlling the motor driving section 48, the belt driving motor 25 is rotated in such a way that the circumferential speed of the intermediate transfer belt 16 is identical to the circumferential speed for the image formation. At the same time, the secondary transfer roller driving motor 33 is rotated in such a way that the circumferential speed of the secondary transfer roller 32 becomes faster than the circumferential speed for the image formation.

In this way, a difference in circumferential speed is provided between the intermediate transfer belt 16 and the secondary transfer roller 32. Thereby, the intermediate transfer belt 16 and the secondary transfer roller 32 rotate with their surfaces in friction with each other. As a result, the residual toner attached to the surface of the secondary transfer roller 32 is torn off by the frictional force generated their surfaces. Further, the residual toner residing inside recesses of the foam section is discharged by deformation of the foam section of the secondary transfer roller 32 caused by the friction generated between their surfaces. Then, the residual toner is moved to the intermediate transfer belt 16, and is collected by the cleaner 37.

Briefly, in the present embodiment, the circumferential speed control section is constituted of the CPU 45 and the motor driving section 48.

The difference in the circumferential speed between the intermediate transfer belt 16 and the secondary transfer roller 32, though depending on the type of the secondary transfer roller 32, should preferably be ±5% or more in the cases of commonly-used expandable elastic rollers, such as NBR rollers foamed by adding ion-conductive-substances to NBR and urethane rollers foamed by adding ion-conductive-substances to urethane. However, it is preferable to obtain an optimum value of the speed difference through experiments because the optimum value differs depending on the surface roughness of the secondary transfer roller 32 and the depth of the foam section.

In Step S8, through controlling the motor driving section 48, the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes slower than the circumferential speed for the image formation. After that, the roller cleaning processing operation is ended.

Figure 4A:
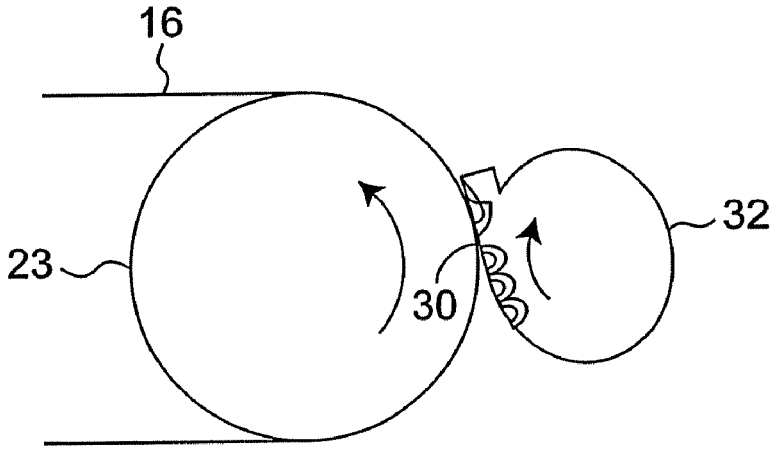
FIG. 4A shows a schematic view of an intermediate transfer belt and a secondary transfer roller, which are shown in FIG. 1, rotating at a circumferential speed.
Figure 4B:
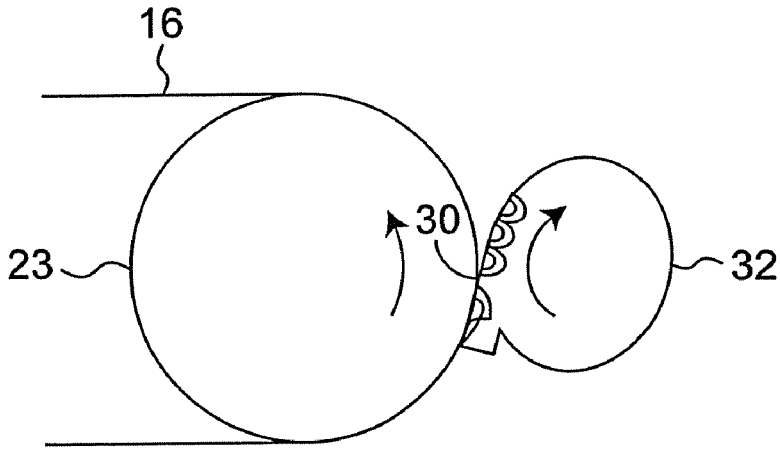
FIG. 4B shows a schematic view of the intermediate transfer belt and the secondary transfer roller rotating at a circumferential speed different from that shown in FIG. 4A.

In the case of providing a difference in the circumferential speed between the intermediate transfer belt 16 and the secondary transfer roller 32 so as to clean the secondary transfer roller 32, the following problems arise when the speed difference is fixed to a predetermined value. FIG. 4 is a schematic view showing a cleaning state of the secondary transfer roller 32 with a difference provided in the circumferential speed between the intermediate transfer belt 16 and the secondary transfer roller 32. When there is a difference in the circumferential speed between the intermediate transfer belt 16 and the secondary transfer roller 32, the surface and the foam section of the secondary transfer roller 32 are deformed by friction with the intermediate transfer belt 16. FIGS. 4A and 4B exaggeratedly show the deformed states of the surface and the foam section of the secondary transfer roller 32.

FIG. 4A shows the case where the circumferential speed of the secondary transfer roller 32 is slower than the circumferential speed of the intermediate transfer belt 16 (i.e., the circumferential speed of the driving roller 23). In this case, the surface of the secondary transfer roller 32 is pulled by the intermediate transfer belt 16. Therefore, the lower surface portion of the secondary transfer roller 32 with respect to the secondary transfer position 30 is greatly deformed as shown in FIG. 4A. As the result, the residual toner on the uneven surface of the secondary transfer roller 32 is mainly cleaned upstream in rotational direction of the secondary transfer roller 32.

FIG. 4B shows the case where the circumferential speed of the secondary transfer roller 32 is faster than the circumferential speed of the intermediate transfer belt 16 (i.e., the circumferential speed of the driving roller 23). In this case, the upper surface portion of the secondary transfer roller 32 with respect to the secondary transfer position 30 is greatly deformed as shown in FIG. 4B. As the result, the residual toner on the uneven surface of the secondary transfer roller 32 is mainly cleaned downstream in rotational direction of the secondary transfer roller 32.

In other words, when the secondary transfer roller 32 is cleaned while the secondary transfer roller 32 fixedly rates at a slower circumferential speed than the circumferential speed of the intermediate transfer belt 16, it is hard to clean the uneven surface of the secondary transfer roller 32 upstream in the rotational direction of the secondary transfer roller 32. Therefore, upon insertion of paper sheet at the time of print operation, the top end of the paper sheet S may be contaminated by the residual toner on the secondary transfer roller 32. On the contrary, when the secondary transfer roller 32 is cleaned while the secondary transfer roller 32 fixedly rotates at a faster circumferential speed than the circumferential speed of the intermediate transfer belt 16, it is hard to clean the surface of the secondary transfer roller 32 downstream in the rotational direction of the secondary transfer roller 32. Therefore, when the rear end of the paper sheet comes out of the secondary transfer position 30 at the time of print operation, the rear end of the paper sheet S may be contaminated by the residual toner on the secondary transfer roller 32.

Accordingly, in the present embodiment, cleaning of the secondary transfer roller 32 is performed by making the circumferential speed of the secondary transfer roller 32 faster than the circumferential speed of the intermediate transfer belt 16 in the Step S7. Thereafter, in the Step S8, cleaning of the secondary transfer roller 32 is performed by making the circumferential speed of the secondary transfer roller 32 slower than the circumferential speed of the intermediate transfer belt 16.

In this way, during one cleaning operation to clean the secondary transfer roller 32, the secondary transfer roller 32 is cleaned not only downstream by making the circumferential speed of the secondary transfer roller 32 slower than the circumferential speed of the intermediate transfer belt 16, but also the secondary transfer roller 32 is cleaned upstream by making the circumferential speed of the secondary transfer roller 32 faster than the circumferential speed of the intermediate transfer belt 16. As the result, it is possible to clean the entire secondary transfer roller 32, and to eliminate the contamination of the front and back ends of the paper sheet during print operation.

It is not necessarily required to perform cleaning of the secondary transfer roller 32 by making the circumferential speed of the secondary transfer roller 32 slower than the circumferential speed of the intermediate transfer belt 16 and by making the circumferential speed of the secondary transfer roller 32 faster than the circumferential speed of the intermediate transfer belt 16 during one cleaning operation. Instead, cleaning of the secondary transfer roller 32 may be performed during two separate cleaning operations as described in detail later.

In the present embodiment, as described above, cleaning of the secondary transfer roller 32 is performed by making the circumferential speed of secondary transfer roller 32 "faster" and "slower" than the circumferential speed of the intermediate transfer belt 16 when the number of print pages after the previous roller cleaning operation, the driving time of printer 10, or the value indicating the toner adhering amount from the contamination detection sensor 38 becomes equal to or more than a cleaning trigger value while transfer operation is not performed.

Thus, the cleaning of the present embodiment is more sufficiently performed as compared with the case of the image forming apparatus involving cleaning of the transfer roller disclosed in JP 08-272233 where cleaning of the transfer roller is performed by changing the peripheral speeds of the image carrier and the transfer roller with respect to the speeds for transfer operation after the peripheral speed of the image carrier relative to the transfer roller is kept generally constant.

In the case of the present embodiment, cleaning of the secondary transfer roller 32 is firstly performed by making the circumferential speed of the secondary transfer roller 32 faster than the circumferential speed of the intermediate transfer belt 16. Then, cleaning of the secondary transfer roller 32 is performed by making the circumferential speed of the secondary transfer roller 32 slower than the circumferential speed of the intermediate transfer belt 16. Thus, it is possible to clean the residual toner on the surface of the secondary transfer roller 32 both upstream and downstream with respect to the secondary transfer position 30. Thereby, the surface of the secondary transfer roller 32 can be totally cleaned.

In the present embodiment, the cleaning processing operation of the secondary transfer roller 32 is performed when a cleaning trigger value is reached by any one of "the number of print pages after the previous roller cleaning operation", "the driving time of the printer 10 after the previous roller cleaning operation", and "the value indicating the toner adhering amount from the contamination detection sensor 38". However, the invention is not limited thereto. The cleaning processing operation may be performed when the cleaning trigger value is reached by all of "the number of print pages", "the driving time" and "the indicative values of toner adhering amount". The cleaning processing operation may also be performed when the cleaning trigger value is reached by any two of "the number of print pages", "the driving time" and "the value indicating toner adhering amount".

In the present embodiment, the secondary transfer roller 32 is cleaned only by mechanical cleaning in the Step S7 and the Step S8. However, the invention is not limited thereto. For example, it becomes possible to enhance the cleaning effects when the present embodiment is used in combination with an electric cleaning where a potential of a positive polarity and a potential of a negative polarity are alternately applied to the secondary transfer roller 32.

Second Embodiment

The overall configuration of the image forming apparatus in the present embodiment is completely identical to the overall configuration of the first embodiment shown in FIG. 1 and FIG. 2. Therefore, detailed description thereof is omitted. The present embodiment is different from the first embodiment in the control program relating to roller cleaning operation of the secondary transfer roller 32 stored in ROM 46, and in the roller cleaning processing operation based on the control program. Hereinafter, the roller cleaning processing operation in the present embodiment is explained with reference to FIG. 1 and FIG. 2.

Figure 5:
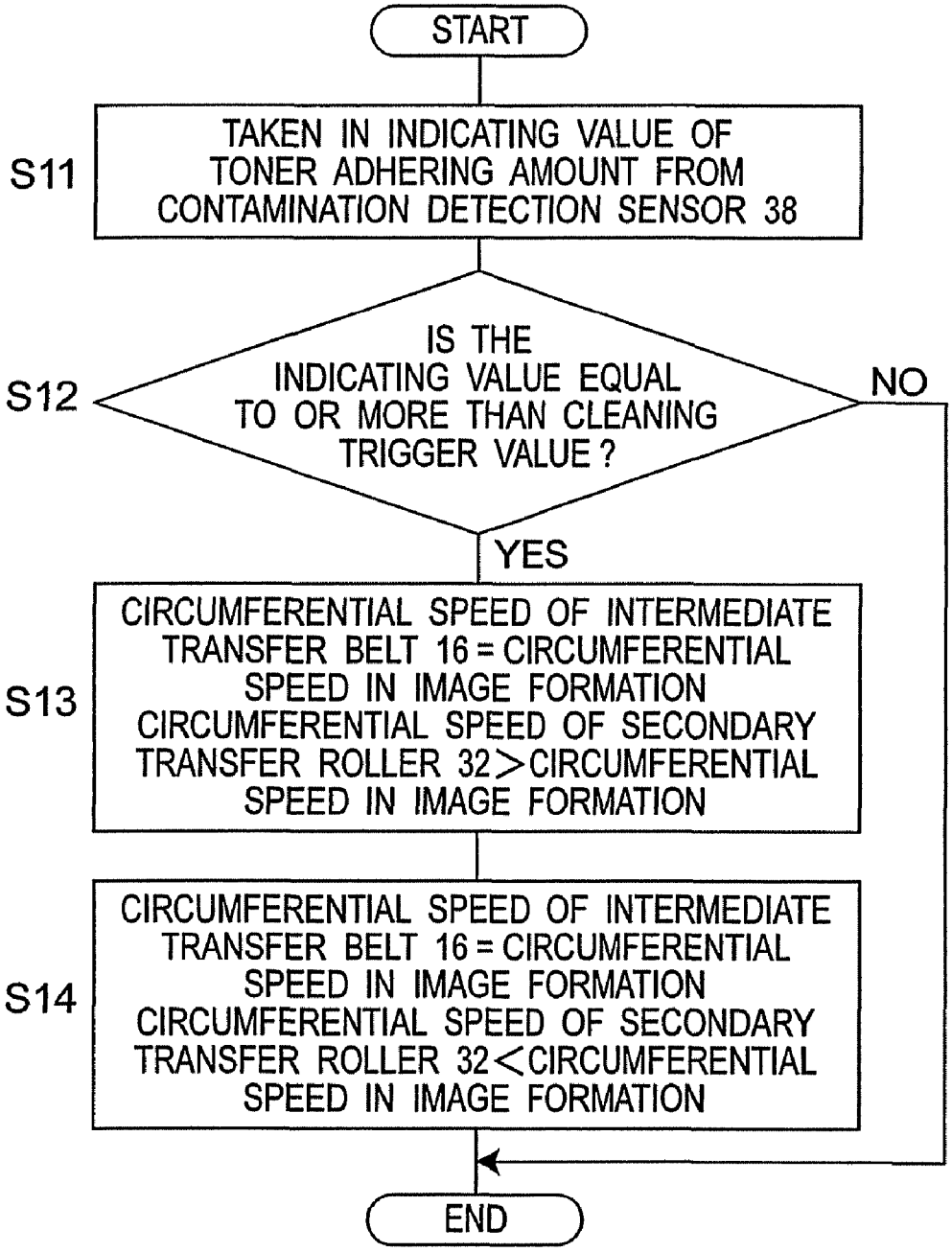
FIG. 5 shows a flow chart of roller cleaning processing operation different from that shown in FIG. 3.

FIG. 5 is a flow chart of the roller cleaning processing operation performed under control by the CPU 45. This roller cleaning processing operation is performed immediately before the start of job execution, as in the case of the first embodiment.

In the present embodiment, the ROM 46 stores "a cleaning trigger value which is a value indicating the toner adhering amount from the contamination detection sensor 381" as the cleaning condition.

Immediately before the start of job execution, the roller cleaning processing operation is started. In Step S11, the CPU 45 takes in a value indicating the toner adhering amount based on a detection signal from the contamination detection sensor 38. In Step S12, it is determined whether or not the value indicating the toner adhering amount taken in the Step S11 is equal to or more than the cleaning trigger value read from the ROM 46. Based on this determination, it is determined whether or not the secondary transfer roller 32 is contaminated. As a result, if the secondary transfer roller 32 is contaminated, i.e., if the indicative value is equal to or more than the cleaning trigger value, then the procedure proceeds to Step S13. If not, the roller cleaning processing operation is ended.

In Step S13, the motor driving section 48 is controlled and the belt driving motor 25 is rotated so that the circumferential speed of the intermediate transfer belt 16 is identical to the circumferential speed for the image formation. At the same time, the secondary transfer roller driving motor 33 is rotated so that the circumferential speed of the secondary transfer roller 32 becomes faster than the circumferential speed for the image formation.

In Step S14, the motor driving section 48 is controlled and the belt driving motor 25 is rotated so that the circumferential speed of the intermediate transfer belt 16 is identical to the circumferential speed for the image formation. At the same time, the secondary transfer roller driving motor 33 is rotated so that the circumferential speed of the secondary transfer roller 32 becomes slower than the circumferential speed for the image formation. After that, the roller cleaning processing operation is ended.

In the present embodiment, as described above, when the value indicating the toner adhering amount from the contamination detection sensor 38 becomes equal to or more than the cleaning trigger value while transfer operation is not performed, cleaning of the secondary transfer roller 32 is started by making the circumferential speed of the secondary transfer roller 32 "faster" and "slower" than the circumferential speed of the intermediate transfer belt 16.

Thus, a difference in circumferential speed is provided between the intermediate transfer belt 16 and the secondary transfer roller 32, so as to tear off the residual toner adhering to the surface of the secondary transfer roller 32 and extrude the residual toner residing inside recesses of the foam section. Thereby, cleaning of the secondary transfer roller 32 can be performed.

Therefore, sufficient cleaning of the transfer roller can be performed as compared with the image forming apparatus disclosed in JP 08-272233 which cleans the transfer roller with the peripheral speed of the image carrier relative to the transfer roller being maintained generally constant.

In this case, cleaning is performed by making the circumferential speed of the secondary transfer roller 32 faster than the circumferential speed of the intermediate transfer belt 16 and then slower than the circumferential speed of the intermediate transfer belt 16. Therefore, the residual toner on the surface of the secondary transfer roller 32 can be cleaned both upstream and downstream with respect to the secondary transfer position 30, so that the surface of the secondary transfer roller 32 can be totally cleaned.

In the present embodiment, the mechanical cleaning in the Steps S13 and S14 may be used in combination with the electric cleaning without any problem.

Figure 6:
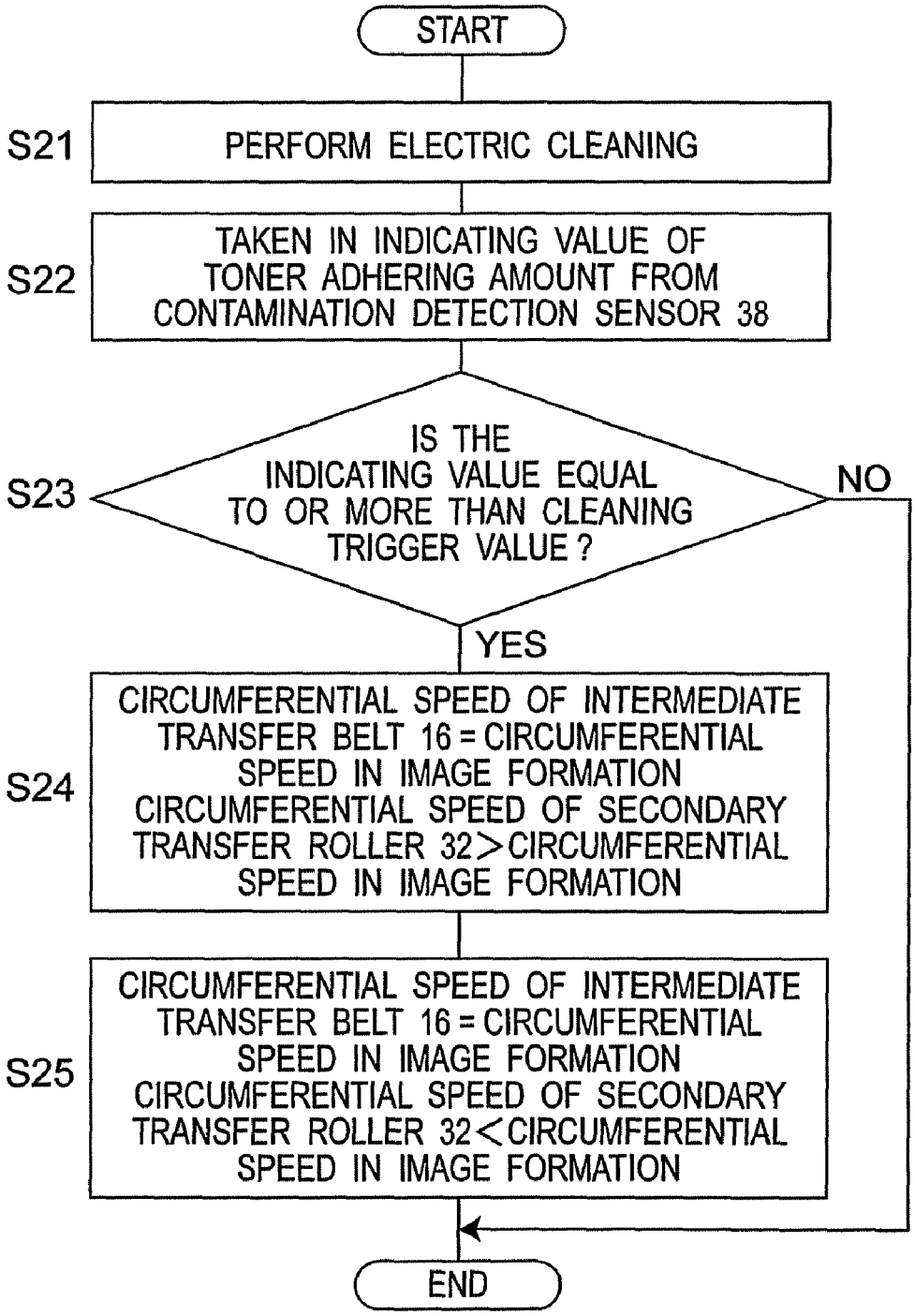
FIG. 6 shows a flow chart of roller cleaning processing operation different from those shown in FIGS. 3 and 5.

FIG. 6 is a flow chart of the roller cleaning processing operation in a modified example in which the electric cleaning is performed prior to mechanical cleaning.

In Step S21, the electric cleaning is performed. Specifically, the motor driving section 48 is controlled so that the intermediate transfer belt 16 and the secondary transfer roller 32 are rotated in such a way that both the circumferential speeds thereof become prescribed circumferential speeds for electric cleaning. Also, the secondary transfer voltage output section 34 is controlled so that a potential with a positive polarity and a potential with a negative polarity are alternately applied to the secondary transfer roller 32. As the result, the residual toner, which is charged to a polarity opposite to the polarity of the applied voltage adhering to the secondary transfer roller 32, is transferred onto the intermediate transfer belt 16 by repulsion.

The reason why a potential with a positive polarity and a potential with a negative polarity are alternately applied to the secondary transfer roller 32 is because the residual toner of the secondary transfer roller 32 includes a regularly-charged (negatively-charge) toner and a reversely-charged (positively-charged) toner and another reason is to increase variation of the potential so as to facilitate removal of the residual toner.

In Step S22, the CPU 45 takes in a value indicating the toner adhering amount based on a detection signal from the contamination detection sensor 38. In Step S23, it is determined whether or not the value indicating the toner adhering amount taken in the Step S22 is equal to or more than the cleaning trigger value read from the ROM 46. Based on this determination, it is determined whether or not the secondary transfer roller 32 is contaminated. As a result, if the secondary transfer roller 32 is contaminated, i.e., if the indicative value is equal to or more than the cleaning trigger value, then the procedure proceeds to Step S24. If not, the roller cleaning processing operation is ended.

In Step S24, the motor driving section 48 is controlled so that the belt driving motor 25 is rotated in such a way that the circumferential speed of the intermediate transfer belt 16 is identical to the circumferential speed for image formation. At the same time, the secondary transfer roller driving motor 33 is rotated so that the circumferential speed of the secondary transfer roller 32 becomes faster than the circumferential speed for the image formation.

In Step S25, the motor driving section 48 is controlled so that the belt driving motor 25 is rotated in such a way that the circumferential speed of the intermediate transfer belt 16 is identical to the circumferential speed for image formation. At the same time, the secondary transfer roller driving motor 33 is rotated so that the circumferential speed of the secondary transfer roller 32 becomes slower than the circumferential speed for image formation. After that, the roller cleaning processing operation is ended.

In the present modified example, as described above, electric cleaning is performed prior to the mechanical cleaning of the secondary transfer roller 32. Specifically, electric cleaning is performed which alternately applies a potential with a positive polarity and a potential with a negative polarity to the secondary transfer roller 32 prior to the mechanical cleaning of the secondary transfer roller 32 wherein the circumferential speed of the secondary transfer roller 32 is made "faster" and "slower" than the circumferential speed of the intermediate transfer belt 16 while transfer operation is not performed.

Therefore, according to the present modified example, higher cleaning effect of the secondary transfer roller 32 can be achieved.

Figure 7:
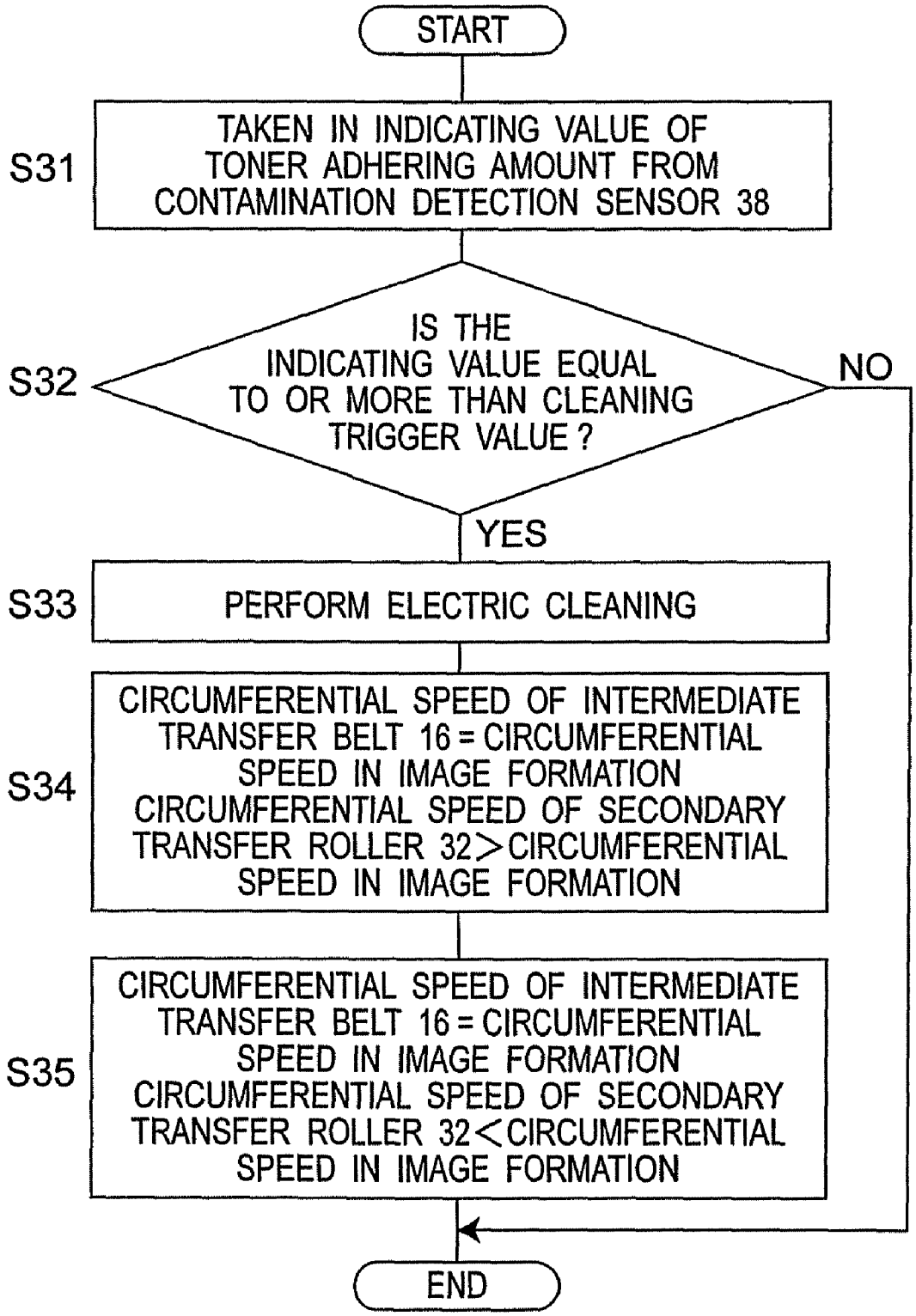
FIG. 7 shows a flow chart of roller cleaning processing operation different from those shown in FIGS. 3, 5 and 6.

FIG. 7 is a flow chart of the roller cleaning processing operation in another modified example in which the electric cleaning is performed prior to mechanical cleaning.

In Step S31, the CPU 45 takes in a value indicating the toner adhering amount based on a detection signal from the contamination detection sensor 38. In Step S32, it is determined whether or not the value indicating the toner adhering amount taken in the Step S31 is equal to or more than the cleaning trigger value read from the ROM 46. Based on this determination, it is determined whether or not the secondary transfer roller 32 is contaminated. As a result, if the secondary transfer roller 32 is contaminated, i.e., if the indicative value is equal to or more than the cleaning trigger value, then the procedure proceeds to Step S33. If not, the roller cleaning processing operation is ended.

In Step S33, the motor driving section 48 is controlled so that the intermediate transfer belt 16 and the secondary transfer roller 32 are rotated in such a way that both the circumferential speeds become prescribed circumferential speeds for electric cleaning. At the same time, the secondary transfer voltage output section 34 is controlled so that a potential with a positive polarity and a potential with a negative polarity are alternately applied to the secondary transfer roller 32. Thereby, the electric cleaning is performed.

In Step S34, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes faster than the circumferential speed for the image formation.

In Step S35, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes slower than the circumferential speed for image formation. After that, the roller cleaning processing operation is ended.

In the present modified example, as described above, is performed prior to mechanical cleaning of the secondary transfer roller 32. Specifically, electric cleaning which alternately applies a potential with a positive polarity and a potential with a negative polarity to the secondary transfer roller 32 is performed prior to mechanical cleaning of the secondary transfer roller 32 wherein the circumferential speed of the secondary transfer roller 32 is made "faster" and "slower" than the circumferential speed of the intermediate transfer belt 16 while transfer operation is not performed. This makes it possible to implement higher cleaning effect of the secondary transfer roller 32.

More specifically, in both the modified examples, the CPU 45 and the secondary transfer voltage output section 34 constitute the cleaning voltage output section.

It is to be noted that in the present modified example, the electric cleaning and the mechanical cleaning are performed in different steps. However, the invention is not limited to this. The electric cleaning and the mechanical cleaning may be performed in the same steps. That is to say, in the state where a potential with a positive polarity and a potential with a negative polarity are alternately applied to the secondary transfer roller 32, the circumferential speed of the secondary transfer roller 32 is controlled so as to be faster and then slower than the circumferential speed for the image formation.

Third Embodiment

The overall configuration of the image forming apparatus in the present embodiment is completely identical to the overall configuration of the first embodiment shown in FIG. 1 and FIG. 2. Therefore, detailed description thereof is omitted. The present embodiment is different from the first embodiment in the control program relating to roller cleaning operation of the secondary transfer roller 32 stored in ROM 46, and in the roller cleaning processing operation based on the control program. Hereinafter, the roller cleaning processing operation in the present embodiment is explained with reference to FIG. 1 and FIG. 2.

Figure 8:
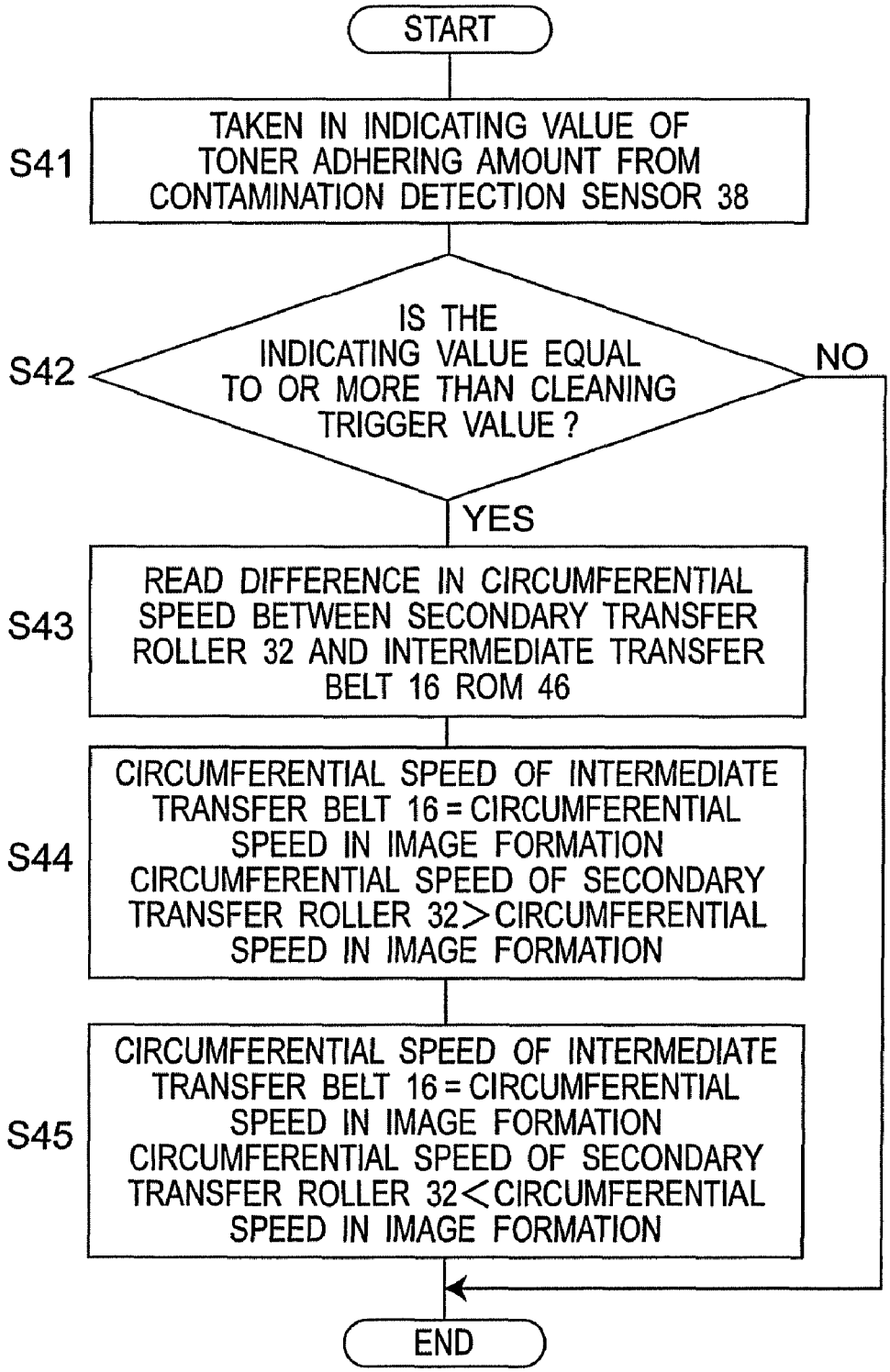
FIG. 8 shows a flow chart of roller cleaning processing operation different from those shown in FIGS. 3 and 5 to 7.

FIG. 8 is a flow chart of the roller cleaning processing operation performed under control by the CPU 45. This roller cleaning processing operation is performed immediately before the start of job execution, as in the case of the first embodiment.

In the present embodiment, "a cleaning trigger value which is a value indicating the toner adhering amount from the contamination detection sensor 38" is stored in the ROM 46 as the cleaning condition. Further, association between "the value indicating the toner adhering amount", and "a difference in the circumferential speed between the secondary transfer roller 32 and the intermediate transfer belt 16" is stored, for example, in the form of a table. In this case, "the difference in the circumferential speed between the secondary transfer roller 32 and the intermediate transfer belt 16" is preferably be set in the range of ±5% to ±10% in the case where the secondary transfer roller 32 is, for example, a general expandable elastic roller. However, the difference is not limited to this range.

Immediately before the start of job execution, the roller cleaning processing operation is started. In Step S41, the CPU 45 takes in a value indicating the toner adhering amount based on a detection signal from the contamination detection sensor 38. In Step S42, it is determined whether or not the value indicating the toner adhering amount taken in the Step S41 is equal to or more than the cleaning trigger value read from the ROM 46. Based on this determination, it is determined whether or not the secondary transfer roller 32 is contaminated. As a result, if the secondary transfer roller 32 is contaminated, i.e., if the indicative value is equal to or more than the cleaning trigger value, then the procedure proceeds to Step S43. If not, the roller cleaning processing operation is ended.

In Step S43, the CPU 45 reads "the difference in the circumferential speed between the secondary transfer roller 32 and the intermediate transfer belt 16" associated with the value indicating the toner adhering amount taken in the Step S41 from the ROM 46.

In Step S44, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes faster than the circumferential speed for the image formation in proportion to "the speed difference" read in the Step S43.

In Step S45, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes slower than the circumferential speed for image formation in proportion to "the speed difference" read in the Step S43. After that, the roller cleaning processing operation is ended.

More specifically, in the present embodiment, the ROM 46 constitutes the speed difference storing section. The CPU 45 for the Step S43 in the roller cleaning processing operation shown in the FIG. 8 constitutes the speed difference setting section.

As described above in the present embodiment, when the value indicating the toner adhering amount from the contamination detection sensor 38 becomes equal to or more than the cleaning trigger value while transfer operation is not performed, cleaning of the secondary transfer roller 32 is performed by making the circumferential speed of the secondary transfer roller 32 "faster" and "slower" than the circumferential speed of the intermediate transfer belt 16. Therefore, more sufficient cleaning of the transfer roller can be performed as compared with the image forming apparatus disclosed in JP 08-272233 where the transfer roller is cleaned while the peripheral speed of the image carrier relative to the transfer roller is maintained generally constant. Moreover, it becomes possible to clean the surface of the secondary transfer roller 32 both upstream and downstream with respect to the secondary transfer position 30.

Further, in this case, a difference in the circumferential speed between the secondary transfer roller 32 and the intermediate transfer belt 16 is set according to a value indicating the toner adhering amount obtained on the basis of a detection signal from the contamination detection sensor 38 (i.e., a contamination level of the secondary transfer roller 32). Therefore, when the adhering amount of the residual toner is large, the speed difference is made larger so as to increase the frictional force and the deformation amount of the foam section. Thereby, it becomes possible to facilitate removal of the residual toner adhering to the surface of the secondary transfer roller 32 and the residual toner residing inside recesses of the foam section.

Also, in the present embodiment, combination of the electric cleaning and the mechanical cleaning in the Steps S44 and S45 makes it possible to enhance the cleaning effect more.

Fourth Embodiment

The overall configuration of the image forming apparatus in the present embodiment is completely identical to the overall configuration of the first embodiment shown in FIG. 1 and FIG. 2. Therefore, detailed description thereof is omitted. The present embodiment is different from the first embodiment in the control program relating to roller cleaning operation of the secondary transfer roller 32 stored in ROM 46, and in the roller cleaning processing operation based on the control program. Hereinafter, the roller cleaning processing operation in the present embodiment is explained with reference to FIG. 1 and FIG. 2.

Figure 9:
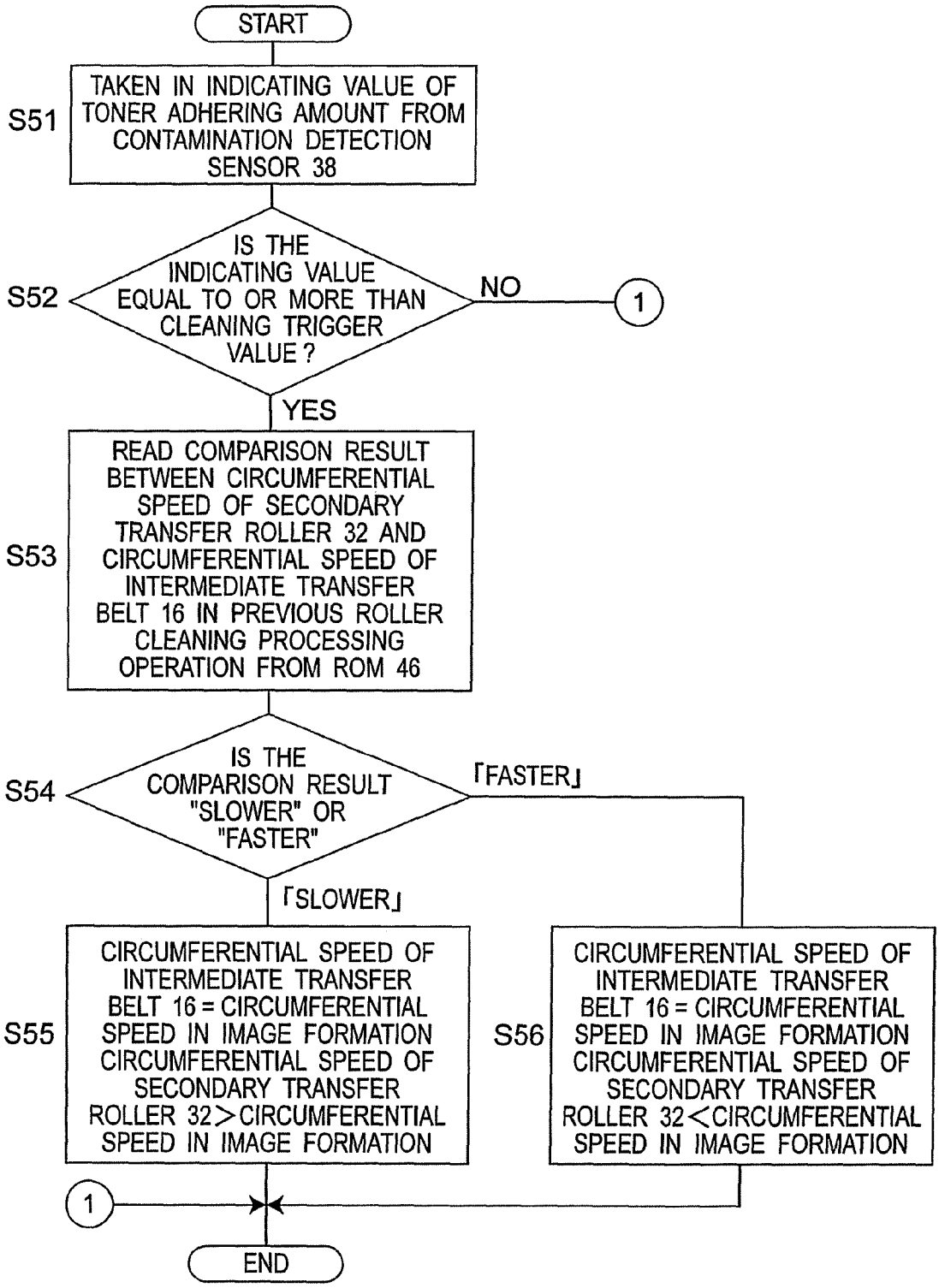
FIG. 9 shows a flow chart of roller cleaning processing operation different from those shown in FIGS. 3 and 5 to 8.
Figure 10:
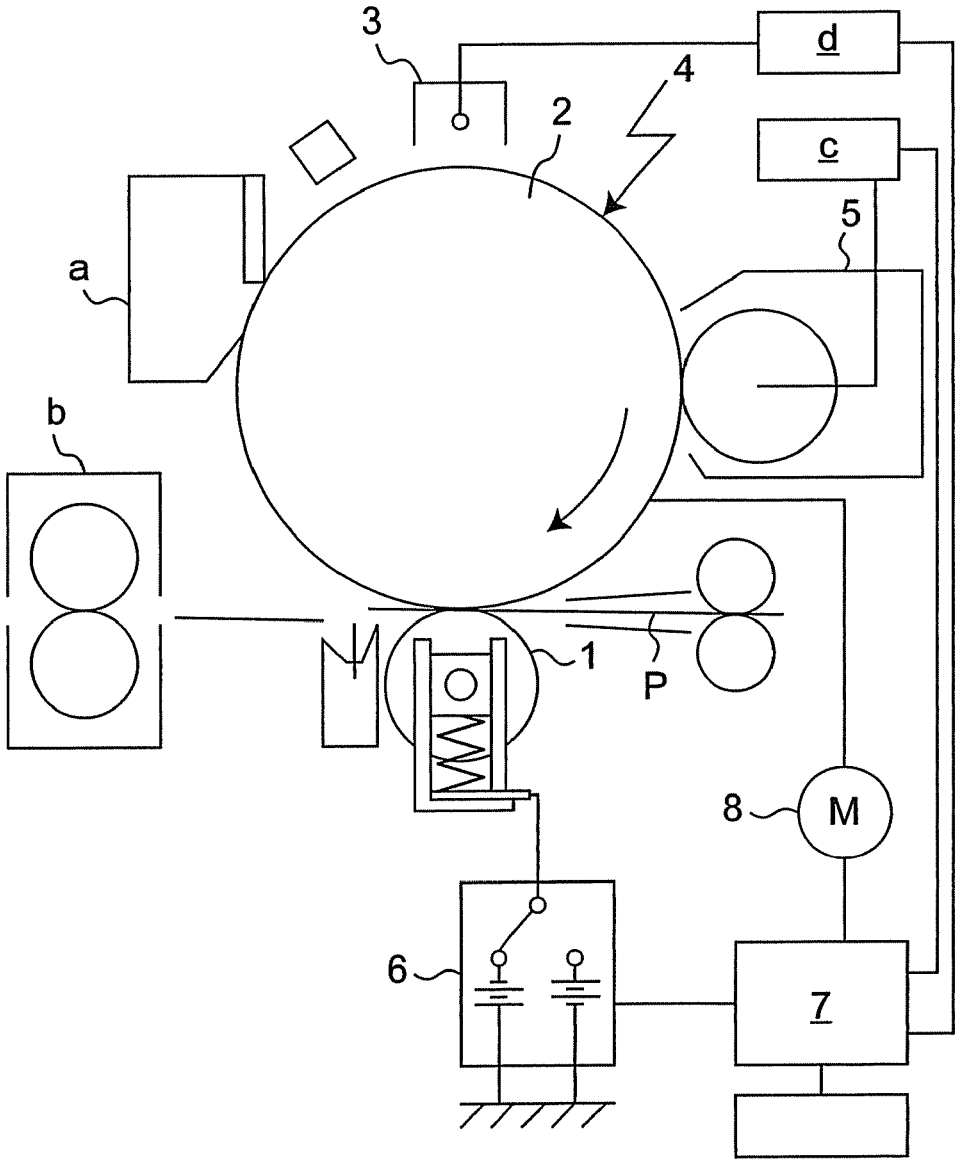
Fig.10 PRIOR ART
FIG. 10 shows parts of a conventional image forming apparatus including an image carrier and a transfer roller.

FIG. 9 is a flow chart of the roller cleaning processing operation performed under control by the CPU 45. This roller cleaning processing operation is performed immediately before the start of job execution, as in the case of the first embodiment.

In the present embodiment, "a cleaning trigger value which is a value indicating the toner adhering amount from the contamination detection sensor 38" is stored in the ROM 46 as the cleaning condition. Further, "a comparison result of the circumferential speed of the secondary transfer roller 32 with the circumferential speed of the intermediate transfer belt 16 in the previous roller cleaning processing operation ("faster" or "slower")", i.e., positive/negative peripheral speed of the secondary transfer roller 32 relative to the peripheral speed of the intermediate transfer belt 16 is also stored.

Immediately before the start of job execution, the roller cleaning processing operation is started. In Step S51, the CPU 45 takes in a value indicating the toner adhering amount based on a detection signal from the contamination detection sensor 38. In Step S52, it is determined whether or not the value indicating the toner adhering amount taken in the Step S51 is equal to or more than the cleaning trigger value read from the ROM 46. Based on this determination, it is determined whether or not the secondary transfer roller 32 is contaminated. As a result, if the secondary transfer roller 32 is contaminated, i.e., if the indicative value is equal to or more than the cleaning trigger value, then the procedure proceeds to Step S53. If not, the roller cleaning processing operation is ended.

In Step S53, the CPU 45 reads "the comparison result of the circumferential speed of the secondary transfer roller 32 with the circumferential speed of the intermediate transfer belt 16 in the previous roller cleaning processing operation (positive/negative peripheral speed of the secondary transfer roller 32 relative to the peripheral speed of the intermediate transfer belt 16)" is read from the ROM 46. In step S54, it is determined whether "the comparison result of the circumferential speed of the secondary transfer roller 32 with the circumferential speed of the intermediate transfer belt 16 is "slower (the relative peripheral speed is negative)" or "faster (the relative peripheral speed is positive)." As a result, if the comparison result is "slower (the relative peripheral speed is negative)", the procedure proceeds to Step S55. If the comparison result is "faster (the relative peripheral speed is positive)", the procedure proceeds to Step S56.

In Step S55, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes faster than the circumferential speed for the image formation. After that, "the comparison result of the circumferential speed of the secondary transfer roller 32 with the circumferential speed of the intermediate transfer belt 16 in the previous roller cleaning processing operation" stored in the ROM 46 is updated to be "slower", and the roller cleaning processing operation is ended.

In Step S56, the motor driving section 48 is controlled so that the belt driving motor 25 is rotated in such a way that the circumferential speed of the intermediate transfer belt 16 is identical to the circumferential speed for the image formation. At the same time, the secondary transfer roller driving motor 33 is rotated so that the circumferential speed of the secondary transfer roller 32 becomes slower than the circumferential speed for image formation. After that, "the comparison result of the circumferential speed of the secondary transfer roller 32 with the circumferential speed of the intermediate transfer belt 16 in the previous roller cleaning processing operation" stored in the ROM 46 is updated to be "faster", and the roller cleaning processing operation is ended.

More specifically, in the present embodiment, the ROM 46 constitutes the relative peripheral speed positive/negative storing section. The CPU 45 for the Steps S53 and S54 in the roller cleaning processing operation shown in FIG. 9 constitute the relative peripheral speed positive/negative setting section.

As described above in the present embodiment, when the value indicating the toner adhering amount from the contamination detection sensor 38 becomes equal to or more than the cleaning trigger value while the transfer operation is not performed, cleaning of the secondary transfer roller 32 is performed by making the circumferential speed of the secondary transfer roller 32 "faster" or "slower" than the circumferential speed of the intermediate transfer belt 16. Therefore, sufficient cleaning of the transfer roller can be performed as compared with the image forming apparatus disclosed in JP 08-272233 which cleans the transfer roller with the peripheral speed of the image carrier relative to the transfer roller being maintained generally constant.

In this case, a change direction of the circumferential speed of the secondary transfer roller 32 with respect to the circumferential speed of the intermediate transfer belt 16 is set based on "the comparison result of the circumferential speed of the secondary transfer roller 32 with the circumferential speed of the intermediate transfer belt 16 in the previous roller cleaning processing operation". Consequently, during two cleaning operations to clean the secondary transfer roller 32, the upstream cleaning of the secondary transfer roller 32 is performed by making the circumferential speed of the secondary transfer roller 32 slower than the circumferential speed of the intermediate transfer belt 16, and the downstream cleaning of the secondary transfer roller 32 is performed by making the circumferential speed of the secondary transfer roller 32 faster than the circumferential speed of the intermediate transfer belt 16. Therefore, the secondary transfer roller 32 can be totally cleaned, and the contamination of the front and back ends of the paper sheet during print operation can be eliminated.

More specifically, in the present embodiment, during one cleaning operation of the secondary transfer roller 32, it is not necessary to change the circumferential speed of the secondary transfer roller 32 twice, so that the roller cleaning processing operation can be facilitated.

In the present embodiment, combination of the electric cleaning and the mechanical cleaning in the Steps S55 and S56 makes it possible to enhance the cleaning effect more.

In the embodiments as stated before, CPU 45 for the Steps S11 and S12 in the roller cleaning processing operation shown in the FIG. 5, for the Steps S22 and S23 in the roller cleaning processing operation shown in FIG. 6, for the Steps S31 and S32 in the roller cleaning processing operation shown in FIG. 7, for the Steps S41 and S42 in the roller cleaning processing operation shown in FIG. 8, and for the Steps S51 and S52 in the roller cleaning processing operation shown in FIG. 9 constitute the transfer roller cleaning start control section, respectively.

It is to be noted that in the first to third embodiments, the circumferential speed of the secondary transfer roller 32 is made "faster" at first and then "slower" than the circumferential speed of the intermediate transfer belt 16. However, the present invention is not limited to this. The circumferential speed of the secondary transfer roller 32 may be made "slower" at first and then "faster".

In the respective embodiments, the circumferential speed of the secondary transfer roller 32 is made faster and then slower than the circumferential speed for the image formation in the mechanical cleaning of the secondary transfer roller 32. However, it is also possible to make the circumferential speed of secondary transfer roller 32 identical to the circumferential speed for the image formation, while making the circumferential speed of the intermediate transfer belt 16 faster and slower than the circumferential speed for the image formation. However, it is easier to control the circumferential speed of the secondary transfer roller 32 than the circumferential speed of the intermediate transfer belt 16. This is because the intermediate transfer belt 16 has a long length and is operated in conjunction with the imaging sections 15Y, 15M, 15C and 15K, which makes the control of the circumferential speed difficult.

In the operation, the circumferential speed of the secondary transfer roller 32 or the intermediate transfer belt 16 is changed with use of the circumferential speed for the image formation as a reference speed.

However, the invention is not limited to this configuration. Any configuration is acceptable as long as the peripheral speed of the secondary transfer roller 32 relative to the intermediate transfer belt 16 is changeably "faster" or "slower".

In the above embodiments, the secondary transfer roller 32 is constituted from a conductive elastic roller foamed by adding ion conductive substances to NBR.

However, the invention is not limited to this constitution. For example, the secondary transfer roller 32 may be constituted from the conductive elastic roller made of urethane, silicon, or EPDM (ethylene propylenediene rubber). The secondary transfer roller 32 may also be constituted from a roller whose surface is a conductive skin layer formed by adding ion conductive substances to NBR, urethane, silicon or EPDM, or a roller having a skin layer which has a coated layer formed by coating the surface of the skin layer with materials high in peelability such as fluorine and silicon. These rollers have uneven surfaces, and therefore the invention is applicable thereto.

In the above embodiments, the method for alternately applying a potential with a positive polarity and a potential with a negative polarity to the secondary transfer roller 32 is performed as the electric cleaning. However, a voltage with a polarity opposite to the polarity of the voltage applied to the secondary transfer roller 32 for secondary transfer may also be applied.

A period of time of the mechanical cleaning performed in each of the embodiments may be set as shown below:

A "fixed time period" is defined to perform cleaning for the fixed time period;

After the mechanical cleaning is performed for "the fixed time period", contamination of the secondary transfer roller 32 is detected on the basis of a detection signal from the contamination detection sensor 38. The mechanical cleaning and the contamination detection are repeated until the level of contamination becomes a prescribed amount;

The mechanical cleaning is performed while the contamination of the secondary transfer roller 32 is detected on the basis of a detection signal from the contamination detection sensor 38. Once the level of contamination reaches the prescribed amount, the mechanical cleaning is ended; and A time period is defined every timing for performing the mechanical cleaning (e.g., at the end of a specified number of printing operations, at the time of jamming, immediately before the start of job execution, immediately after job end and so on) to perform the cleaning for the defined time period.

As is already described in the summary of invention, one aspect of the present invention provides an image forming device which has a rotatable image carrier for carrying a toner image on a surface of the image carrier, an image forming section for forming a toner image on the surface of the image carrier with charged toner, a transfer roller which is rotatably put in pressure contact with the surface of the image carrier and which transfers the toner image carried on the surface of the image carrier onto a transfer material, and a circumferential speed control section for controlling a circumferential speed of at least either one of the transfer roller and the image carrier at a time of cleaning off contamination on the surface of the transfer roller so that a circumferential speed of the transfer roller is made relatively faster and then slower than a circumferential speed of the image carrier, or is made relatively slower and then faster than the circumferential speed of the image carrier.

According to the configuration, the circumferential speed of the transfer roller is controlled so as to be relatively "faster" and "slower" than the circumferential speed of the image carrier in cleaning off contamination on the surface of the transfer roller. Therefore, the residual toner adhering to the surface of the transfer roller is torn off by the frictional force generated between the transfer roller and the image carrier, which achieves sufficient cleaning of the surface of the transfer roller. Further, when the transfer roller has a foam section on its surface, the frictional force deforms the foam section. As the result, the residual toner residing inside recesses of the foam section can be extruded and therefore more sufficient cleaning of the surface of the transfer roller can be achieved.

The circumferential speed of the transfer roller is controlled so as to be relatively "faster" and then "slower" than the circumferential speed of the image carrier. Thus, in the vicinity of the contact section between the image carrier and the transfer roller whose surface is elastically deformed by the frictional force, it becomes possible to clean the surface of the transfer roller in both upstream and downstream directions with respect to rotation of the transfer roller. That is, the surface region of the transfer roller can be totally cleaned.

In one embodiment, the image forming apparatus has a contamination detection sensor for detecting contamination on the surface of the transfer roller; and a transfer roller cleaning start control section which orders the circumferential speed control section to control the circumferential speed of at least either one of the transfer roller and the image carrier to start cleaning of the transfer roller when a level of contamination on the surface of the transfer roller detected by the contamination detection sensor becomes a predetermined level of contamination or higher.

According to this embodiment, cleaning of the transfer roller is started when a level of contamination on the surface of the transfer roller detected by the contamination detection sensor becomes a predetermined level of contamination or higher. This makes it possible to prevent the surfaces of the transfer roller and the image carrier from being worn and deteriorated due to the frictional force between the transfer roller and the image carrier.

In one embodiment, the image forming apparatus has a cleaning voltage output section for performing electric cleaning by applying a voltage having a polarity identical to a charged polarity of residual toner adhering to the surface of the transfer roller to the transfer roller so as to transfer the residual toner onto the image carrier by a potential difference between the residual toner and the transfer roller before the circumferential speed control section controls the circumferential speed of at least either one of the transfer roller and the image carrier.

According to this embodiment, electric cleaning of the transfer roller is performed before mechanical cleaning of the transfer roller is performed by the friction force between the transfer roller and the image carrier. Therefore, the cleaning effect is more enhanced as compared with the case where only the mechanical cleaning is performed.

In one embodiment, the image forming apparatus has a cleaning voltage output section for performing electric cleaning by applying a voltage having a polarity identical to a charged polarity of residual toner adhering to the surface of the transfer roller to the transfer roller so as to transfer the residual toner onto the image carrier by a potential difference between the residual toner and the transfer roller when the circumferential speed control section controls the circumferential speed of at least either one of the transfer roller and the image carrier.

According to this embodiment, electric cleaning of the transfer roller is performed, and at the same time mechanical cleaning of the transfer roller is performed by the friction force between the transfer roller and the image carrier. Therefore, the cleaning effect is enhanced as compared with the case where only the mechanical cleaning is performed. In addition, since electric cleaning and mechanical cleaning are simultaneously performed, cleaning procedures of the transfer roller and cleaning control are simplified as compared with the case where those cleanings are separately performed.

In one embodiment, the image forming apparatus has a speed difference storing section for storing a speed difference between the circumferential speed of the transfer roller and the circumferential speed of the image carrier in association with the level of contamination of the transfer roller; and a speed difference setting section for setting the speed difference between the circumferential speed of the transfer roller and the circumferential speed of the image carrier controlled by the circumferential speed control section based on the level of contamination of the transfer roller detected by the contamination detection sensor and the speed difference stored in the speed difference storing section, wherein the circumferential speed control section controls the circumferential speed of at least either one of the transfer roller and the image carrier so that the circumferential speed of the transfer roller is made relatively faster and slower than the circumferential speed of the image carrier in proportion to the speed difference.

In this embodiment, according to the level of contamination of the transfer roller detected by the contamination detection sensor, cleaning of the transfer roller is performed by using the speed difference between the circumferential speed of the transfer roller and the circumferential speed of the image carrier. In the case where adhering amount of the residual toner is large, the speed difference is made larger so as to increase the frictional force and the deformation amount of the foam section, by which it becomes possible to adequately clean the transfer roller according to the level of contamination.

In one embodiment, the image forming apparatus has a relative peripheral speed positive/negative storing section for storing a positive/negative peripheral speed of the transfer roller relative to the image carrier in previous cleaning operation; a relative peripheral speed positive/negative setting section for setting the peripheral, speed of the transfer roller relative to the image carrier to negative when the relative peripheral speed stored is positive based on the relative positive/negative peripheral speed stored in the relative peripheral speed positive/negative storing section, while setting the peripheral speed of the transfer roller relative to the image carrier to positive when the stored relative peripheral speed is negative, wherein the circumferential speed control section controls the circumferential speed of at least either one of the transfer roller and the image carrier, so that the peripheral speed of the transfer roller relative to the image carrier is made positive or negative as set by the relative peripheral speed positive/negative setting section, and thereby in combination with control of the circumferential speed in the previous cleaning operation, the circumferential speed control section controls the circumferential speed of at least either one of the transfer roller and the image carrier so that the circumferential speed of the transfer roller is made relatively faster and then slower than the circumferential speed of the image carrier, or is made relatively slower and then faster.

According to this embodiment, when the peripheral speed of the transfer roller relative to the image carrier in previous cleaning operation is positive (increased speed), the peripheral speed of the transfer roller relative to the image carrier is set to negative (decrease speed). On the other hand, when the peripheral speed of the transfer roller relative to the image carrier in previous cleaning operation is negative (decreased speed), the peripheral speed of the transfer roller relative to the image carrier is set to positive (increase speed).

Thus, the peripheral speed of the transfer roller relative to the image carrier is controlled to be made positive and negative. Therefore, by twice performing cleaning operations to the transfer roller which is elastically deformed with the frictional force, it becomes possible to clean the surface of the transfer roller in both upstream and downstream directions with respect to rotation of the transfer roller.

As the result, the cleaning operation of the transfer roller can be facilitated, so that cleaning control is simplified.

Major effects of the invention are as follows. When contamination on the surface of the transfer roller is cleaned off, the image forming apparatus of the present invention is controlled to be relatively "faster" and then "slower" or "slower" and then "faster" than the circumferential speed of the image carrier. Therefore, the residual toner adhering to the surface of the transfer roller is torn off by the frictional force generated between the transfer roller and the image carrier. Thus, the surface of the transfer roller is sufficiently cleaned. Further, when the transfer roller has for example a deformable foam section on its surface, the foam section is deformed by frictional force. As the result, the residual toner residing inside recesses of the foam section can be extruded, so that more sufficient cleaning of the surface of the transfer roller can be achieved.

Further, the circumferential speed of the transfer roller is controlled so as to be relatively "faster" and then "slower" than the circumferential speed of the image carrier. Therefore, in the vicinity of the contact section between the image carrier and the transfer roller whose surface is elastically deformed by the frictional force, it becomes possible to clean the surface of the transfer roller in both upstream and downstream directions with respect to rotation of the transfer roller. That is, the surface region of the transfer roller can be totally cleaned.

According to the level of contamination of the transfer roller detected by the contamination detection sensor, cleaning of the transfer roller is performed by using the speed difference between the circumferential speed of the transfer roller and the circumferential speed of the image carrier. In the case where adhering amount of the residual toner is large, the speed difference is made larger so as to increase the frictional force and the deformation amount of the foam section, by which it becomes possible to adequately clean the transfer roller according to the level of contamination.

When positive/negative of the relative peripheral speed of the transfer roller with respect to the image carrier is oppositely set to positive/negative of the relative peripheral speed of the transfer roller in previous cleaning operation, the cleaning operation and cleaning control of the transfer roller can be simplified. This is because the transfer roller is relatively "faster" and then "slower" or vice versa than the image carrier by performing twice cleaning operations.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

REFERENCE SIGNS LIST

10: printer
11: image forming section
12: feed section
13: fixing section
14: control section
16: intermediate transfer belt
17: photoconductor drum
21: primarily transfer roller
23: driving roller
24: driven roller
25: belt driving motor
30: secondary transfer position
32: secondary transfer roller
33: secondary transfer roller driving motor
34: secondary transfer voltage output section
38: contamination detection sensor
41: communication interface section
42: image processing section
43: image memory
44: laser diode driving section
45: central processing unit
46: read only memory
47: random access memory
48: motor driving section
49: bus

CITATION LIST

Patent Literature

Reference 1: JP 08-272233 A

The invention claimed is:

1. An image forming device, comprising:

a rotatable image carrier for carrying a toner image on a surface of the image carrier;

an image forming section for forming a toner image on the surface of the image carrier with charged toner;

a transfer roller which is rotatably put in pressure contact with the surface of the image carrier and which transfers the toner image carried on the surface of the image carrier onto a transfer material; and a circumferential speed control section for controlling a circumferential speed of at least either one of the transfer roller and the image carrier at a time of cleaning off contamination on the surface of the transfer roller so that a circumferential speed of the transfer roller is made relatively faster and then slower than a circumferential speed of the image carrier, or is made relatively slower and then faster than the circumferential speed of the image carrier.

2. The image forming apparatus according to claim 1, comprising:

a contamination detection sensor for detecting contamination on the surface of the transfer roller; and a transfer roller cleaning start control section which orders the circumferential speed control section to control the circumferential speed of at least either one of the transfer roller and the image carrier to start cleaning of the transfer roller when a level of contamination on the surface of the transfer roller detected by the contamination detection sensor becomes a predetermined level of contamination or higher.

3. The image forming apparatus according to claim 2, comprising:

a speed difference storing section for storing a speed difference between the circumferential speed of the transfer roller and the circumferential speed of the image carrier in association with the level of contamination of the transfer roller; and a speed difference setting section for setting the speed difference between the circumferential speed of the transfer roller and the circumferential speed of the image carrier controlled by the circumferential speed control section based on the level of contamination of the transfer roller detected by the contamination detection sensor and the speed difference stored in the speed difference storing section, wherein the circumferential speed control section controls the circumferential speed of at least either one of the transfer roller and the image carrier so that the circumferential speed of the transfer roller is made relatively faster and slower than the circumferential speed of the image carrier in proportion to the speed difference.

4. The image forming apparatus according to claim 2, comprising:

a relative peripheral speed positive/negative storing section for storing a positive/negative peripheral speed of the transfer roller relative to the image carrier in previous cleaning operation; and a relative peripheral speed positive/negative setting section for setting the peripheral speed of the transfer roller relative to the image carrier to negative when the relative peripheral speed stored is positive based on the relative positive/negative peripheral speed stored in the relative peripheral speed positive/negative storing section, while setting the peripheral speed of the transfer roller relative to the image carrier to positive when the stored relative peripheral speed is negative, wherein the circumferential speed control section controls the circumferential speed of at least either one of the transfer roller and the image carrier, so that the peripheral speed of the transfer roller relative to the image carrier is made positive or negative as set by the relative peripheral speed positive/negative setting section, and thereby in combination with control of the circumferential speed in the previous cleaning operation, the circumferential speed of at least either one of the transfer roller and the image carrier is controlled so that the circumferential speed of the transfer roller is made relatively faster and then slower than the circumferential speed of the image carrier, or is made relatively slower and then faster.

5. The image forming apparatus according to claim 1, comprising:

a cleaning voltage output section for performing electric cleaning by applying a voltage having a polarity identical to a charged polarity of residual toner adhering to the surface of the transfer roller to the transfer roller so as to transfer the residual toner onto the image carrier by a potential difference between the residual toner and the transfer roller before the circumferential speed control section controls the circumferential speed of at least either one of the transfer roller and the image carrier.

6. The image forming apparatus according to claim 1, comprising:

a cleaning voltage output section for performing electric cleaning by applying a voltage having a polarity identical to a charged polarity of residual toner adhering to the surface of the transfer roller to the transfer roller so as to transfer the residual toner onto the image carrier by a potential difference between the residual toner and the transfer roller when the circumferential speed control section controls the circumferential speed of at least either one of the transfer roller and the image carrier.

7. A transfer roller cleaning method in an image forming device having:

a rotatable image carrier for carrying a toner image on a surface of the image carrier;

an image forming section for forming a toner image on the surface of the image carrier with charged toner; and a transfer roller which is rotatably put in pressure contact with the surface of the image carrier and which transfers the toner image carried on the surface of the image carrier onto a transfer material, the transfer roller cleaning method, comprising:

making the circumferential speed of the transfer roller relatively faster or slower than the circumferential speed of the image carrier;

changing the circumferential speed of the transfer roller to a relatively slower circumferential speed than the circumferential speed of the image carrier when the circumferential speed of the transfer roller is relatively faster than the circumferential speed of the image carrier; and changing the circumferential speed of the transfer roller to a relatively faster circumferential speed than the circumferential speed of the image carrier when the circumferential speed of the transfer roller is relatively slower than the circumferential speed of the image carrier.

8. The transfer roller cleaning method according to claim 7, wherein the image forming apparatus further comprises:

a circumferential speed control section for controlling a circumferential speed of at least either one of the transfer roller and the image carrier at a time of cleaning off contamination on the surface of the transfer roller so that a circumferential speed of the transfer roller is made relatively faster and then slower than a circumferential speed of the image carrier, or is made relatively slower and then faster than the circumferential speed of the image carrier, a contamination detection sensor for detecting contamination on the surface of the transfer roller; and a transfer roller cleaning start control section, wherein with use of the transfer roller cleaning start control section, the circumferential speed control section is ordered to control the circumferential speed of at least either one of the transfer roller and the image carrier to start cleaning of the transfer roller when a level of contamination on the surface of the transfer roller detected by the contamination detection sensor becomes a predetermined level of contamination or higher.

9. The transfer roller cleaning method according to claim 8, wherein the image forming apparatus further comprises a cleaning voltage output section, and with use of the cleaning voltage output section, electric cleaning is performed by applying a voltage having a polarity identical to a charged polarity of residual toner adhering to the surface of the transfer roller to the transfer roller so as to transfer the residual toner onto the image carrier by a potential difference between the residual toner and the transfer roller before the circumferential speed control section controls the circumferential speed of at least either one of the transfer roller and the image carrier.

10. The transfer roller cleaning method according to claim 8, wherein the image forming apparatus further comprises a cleaning voltage output section, and with use of the cleaning voltage output section, electric cleaning is performed by applying a voltage having a polarity identical to a charged polarity of residual toner adhering to the surface of the transfer roller to the transfer roller so as to transfer the residual toner onto the image carrier by a potential difference between the residual toner and the transfer roller when the circumferential speed control section controls the circumferential speed of at least either one of the transfer roller and the image carrier.

11. The transfer roller cleaning method according to claim 8, wherein the image forming apparatus further comprises:

a speed difference storing section for storing a speed difference between the circumferential speed of the transfer roller and the circumferential speed of the image carrier in association with the level of contamination of the transfer roller; and a speed difference setting section for setting the speed difference between the circumferential speed of the transfer roller and the circumferential speed of the image carrier controlled by the circumferential speed control section based on the level of contamination of the transfer roller detected by the contamination detection sensor and the speed difference stored in the speed difference storing section, and wherein with use of the circumferential speed control section, the circumferential speed of at least either one of the transfer roller and the image carrier is controlled so that the circumferential speed of the transfer roller is made relatively faster and slower than the circumferential speed of the image carrier in proportion to the speed difference.

12. The transfer roller cleaning method according to claim 8, wherein the image forming apparatus further comprises:

a relative peripheral speed positive/negative storing section for storing a positive/negative peripheral speed of the transfer roller relative to the image carrier in previous cleaning operation; and a relative peripheral speed positive/negative setting section for setting the peripheral speed of the transfer roller relative to the image carrier to negative when the relative peripheral speed stored is positive based on the relative positive/negative peripheral speed stored in the relative peripheral speed positive/negative storing section, while setting the peripheral speed of the transfer roller relative to the image carrier to positive when the stored relative peripheral speed is negative, and wherein with use of the circumferential speed control section, the circumferential speed of at least either one of the transfer roller and the image carrier is controlled so that the peripheral speed of the transfer roller relative to the image carrier is made positive or negative as set by the relative peripheral speed positive/negative setting section, and thereby in combination with control of the circumferential speed in the previous cleaning operation, the circumferential speed of at least either one of the transfer roller and the image carrier is controlled so that the circumferential speed of the transfer roller is made relatively faster and then slower than the circumferential speed of the image carrier, or is made relatively slower and then faster.

* * * * *